US005597388A

United States Patent [19]

Fritzsche

[11] Patent Number: 5,597,388

[45] **Date of Patent: *Jan. 28, 1997**

[54] PROCESS FOR FIXATION OF DYES CONTAINING AT LEAST ONE POLYMERIZABLE DOUBLE BOND BY MEANS OF UV LIGHT

[75] Inventor: Katharina Fritzsche, Weil am Rhein, Germany

[73] Assignee: Ciba-Geigy Corporation, Tarrytown, N.Y.

[ * ] Notice: The term of this patent shall not extend beyond the expiration date of Pat. No. 5,409,504.

[21] Appl. No.: 343,587

[22] PCT Filed: May 21, 1993

[86] PCT No.: PCT/EP93/01272

§ 371 Date: Dec. 2, 1994

§ 102(e) Date: Dec. 2, 1994

[87] PCT Pub. No.: WO93/24701

PCT Pub. Date: Dec. 9, 1993

[30] Foreign Application Priority Data

| | | | |
|---|---|---|---|
| Jun. 4, 1992 | [CH] | Switzerland | 1802/92 |
| Jun. 4, 1992 | [CH] | Switzerland | 1803/92 |
| Dec. 1, 1992 | [CH] | Switzerland | 3684/92 |

[51] Int. Cl.[6] ..... D06P 5/20; D06P 1/38

[52] U.S. Cl. ..... 8/444; 8/115.53; 8/532; 8/555; 8/576; 8/582; 8/586; 8/543; 8/549

[58] Field of Search ..... 8/115.53, 444, 8/532, 606, 555, 576, 582, 586, 916–928, 543, 549, 647

[56] References Cited

U.S. PATENT DOCUMENTS

| | | | |
|---|---|---|---|
| 4,588,411 | 5/1986 | Schubli et al. | 8/528 |
| 4,678,474 | 7/1987 | Ueda et al. | 8/543 |
| 5,238,465 | 8/1993 | Fritzsche | 8/444 |
| 5,409,504 | 4/1995 | Fritzsche | 8/444 |

FOREIGN PATENT DOCUMENTS

| | | |
|---|---|---|
| 0144093 | 6/1985 | European Pat. Off. . |
| 0168749 | 1/1986 | European Pat. Off. . |
| 0466648 | 1/1992 | European Pat. Off. . |
| 56-096976 | 8/1981 | Japan . |
| 57-167455 | 8/1982 | Japan . |
| 4-095053 | 3/1993 | Japan . |
| 388254 | 6/1965 | Switzerland . |
| 899798 | 6/1962 | United Kingdom . |

OTHER PUBLICATIONS

C.A. 98: 108842 p, Ab of JP 57–167455 Oct. 1982.

C.A. 117: 70513 c, Ab of JP 4095053 Mar. 1992.

C.A. 95: 205340u, Ab of JP 56–096976, Aug. 1981.

C.A. 105: 24767t (1986); Ab of DE 3,436,197 Jan. 1986.

Journal of Polymer Science, Polymer Chemistry Edition, 29 1991, N.Y., pp. 1319–1327, "Water–Soluble Photoinisiators in Hydroxy Alkyl Phenyl Ketones".

McGraw–Hill Dictionary of Scientific and Technical Terms, Third Edition, 1984, Editor Sybil P. Parker pp. 1580–1640.

*Primary Examiner*—Margaret Einsmann

*Attorney, Agent, or Firm*—Kevin T. Mansfield

[57] ABSTRACT

Process for the dyeing or printing of organic material, in particular fiber material, which comprises applying dyes containing at least one polymerizable double bond together with at least one colorless cationic compound containing at least one polymerizable double bond and, if desired, one or more colorless nonionic compounds containing at least one polymerizable double bond, and at least one photoinitiator, and, if desired, further auxiliaries to the organic material, in particular fiber material, and then fixing them by means of UV light.

41 Claims, No Drawings

PROCESS FOR FIXATION OF DYES CONTAINING AT LEAST ONE POLYMERIZABLE DOUBLE BOND BY MEANS OF UV LIGHT

The invention relates to a process for the fixation of dyes containing at least one polymerisable double bond on organic materials by irradiation with UV light in the presence of colourless polymerisable compounds and photoinitiators.

According to conventional methods, the fibre materials, for example woven fabrics, knitted fabrics, felt-like materials and others treated with the dyes are in practice in many cases subjected to a plurality of further operations in which the absorbed dye is usually fixed on the substrate by means of heat, using expensive steaming machines which take up a lot of space. The literature discloses dyeing methods which use nonionic colourless compounds containing at least one polymerisable double bond in dye application and effect the subsequent fixation of the dye by means of ionising electron beams.

These fixation methods still require fairly complicated equipment and furthermore leave something to be desired with respect to fixation yield, which has an adverse effect on the ecological balance.

The object of the present invention is to provide an improved process for the fixation of dyes containing at least one polymerisable double bond.

Accordingly, the present invention relates to a process for the dyeing or printing of organic material, in particular fibre material, which comprises applying dyes containing at least one polymerisable double bond together with at least one colourless cationic compound containing at least one polymerisable double bond and, if desired, one or more colourless nonionic compounds containing at least one polymerisable double bond, and at least one photoinitiator, and, if desired, further auxiliaries to the organic material, in particular fibre material, and then fixing them by means of UV light. The process according to the invention is distinguished by high degrees of fixation and makes it possible to replace the steaming machines which require high costs and a lot of space by simple UV irradiation units. Compared with conventional methods, the use of fixing alkali can be omitted, so that complete fixation of the dye takes place without the need for subsequent rinsing or washing.

Suitable dyes are water-soluble and water-insoluble dyes carrying one polymerisable double bond. This polymerisable group can also be linked to the chromophore via a bridging member, for example a $—(CH_2—CH_2—O)_n—$ group.

Water-soluble dyes are understood to mean in particular those containing chromophores having sulfo groups. Suitable water-insoluble dyes am disperse dyes having at least one polymerisable group and being soluble in the radiation-polymerisable binder.

Suitable polymerisable double bonds are vinyl, chlorovinyl, vinylsulfonyl, allyl, allylsulfonyl, acrylate, methacrylate, acrylamide, methacrylamide, haloacrylamide or styryl groups and derivatives of cinnamic acid.

Dyes suitable for this fixation process include those containing at least one activated unsaturated group, in particular an unsaturated aliphatic group, for example vinyl, halovinyl, styryl, acryloyl or methacryloyl, or at least one polymerisable ring system. Examples of such groups are unsaturated groups containing halogen atoms, such as halomaleoyl, halopropioloyl, α- or β-bromo- or -chloroacryloyl, halogenareal vinylacetyl groups, halocrotonyl or halomethacryloyl. Furthermore, those groups which are easily converted, for example by elimination of hydrogen halide, into halogen-containing unsaturated groups, for example a dichloro- or dibromopropionyl group, are also suitable. Halogen atoms are here understood to mean fluorine, chlorine, bromine and iodine atoms and also pseudohalogen atoms, for example a cyano group. The process according to the invention also gives good results with dyes containing α-bromoacryloyl. Suitable dyes containing a polymerisable double bond are preferably those containing at least one acryloyl, methacryloyl, α-bromoacryloyl, α-chloroacryloyl, vinyl or vinylsulfonyl radical; very particular preference is given to those containing at least one acryloyl, α-bromoacryloyl or vinylsulfonyl radical. Suitable dyes containing a polymerisable ting system are preferably those containing at least one epoxy radical.

The chromophoric systems used can belong to a wide range of classes of dyes.

In a preferred embodiment of the process according to the invention, the dyes used are those of the formula $$D—(P)_r \qquad (1),$$

in which D is the radical of an organic dye from the monoazo or polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone or perylenetetracarbimide series, P is a radical having a polymerisable double bond and r is the number 1, 2, 3, 4, 5 or 6.

Preference is given to dyes of the formula, $$D'—(P)_r \qquad (1a)$$

in which P and r are as defined above and D' is the radical of an organic monoazo, polyazo, formazan, anthraquinone, phthalocyanine or dioxazine dye.

In a particularly preferred embodiment of the process according to the invention, the dyes used are water-soluble dyes of the formula (1),
in which a) D is the radical of an anthraquinone dye of the formula

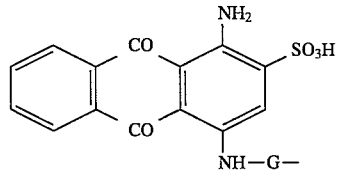

(2)

which G is a phenylene, cyclohexylene or $C_2$–$C_6$alkylene radical, it being possible for the anthraquinone ring to be substituted by a further sulfo group and for G as phenyl radical to be substituted by alkyl of 1 to 4 C atoms, alkoxy of 1 to 4 C atoms, halogen, carboxyl or sulfo;

b) D is the radical of a phthalocyanine dye of the formula

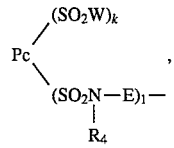

(3)

in which Pc is the radical of a copper phthalocyanine or nickel phthalocyanine; W is —OH and/or $—NR_5R_6$; $R_5$ and $R_6$, independently of one another, are hydrogen or alkyl of 1 to 4 carbon atoms which may be substituted by hydroxyl or sulfo; $R_4$ is hydrogen or alkyl of 1 to 4 carbon atoms; E is a phenylene radical which may be substituted by alkyl of 1 to 4 C atoms, halogen, carboxyl or sulfo; or is an alkylene radical of 2 to 6 C atoms, preferably a sulfophenylene or ethylene radical; k is 0, 1, 2 or 3; 1 is 1,2, 3 or 4 and k+1 is 4;

c) D is the radical of a dioxazine dye of the formulae

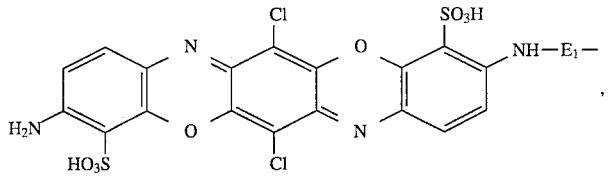

(4)

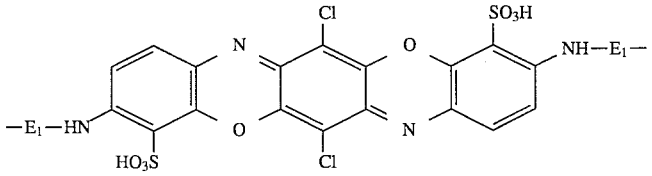

(4a)

or

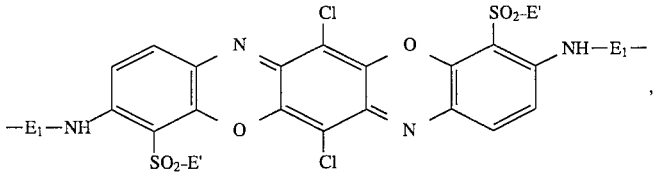

(4b)

in which $E_1$ and E', independently of one another are a phenylene radical which may be substituted by alkyl of 1 to 4 C atoms, halogen, carboxyl or sulfo; or are an alkylene radical of 2 to 6 C atoms which may be substituted by amino, carbamoyl, carboxyalkylenecarboxamido, sulfo, sulfamoyl and sulfato; and the outer benzene rings in formulae (4) to (4b) may be further substituted by alkyl of 1 to 4 C atoms, alkoxy of 1 to 4 C atoms, acetylamino, nitro, halogen, carboxyl or sulfo.

Dyes of the formula (1) in which D is the radical of an azo dye, in particular a radical of the formulae (5) to (5i), are also particularly preferably used:

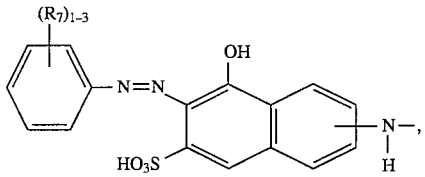

(5)

in which $(R_7)_{1-3}$ is 1 to 3 substituents from the group consisting of $C_{1-4}$alkyl, $C_{1-4}$alkoxy, halogen, carboxyl and sulfo:

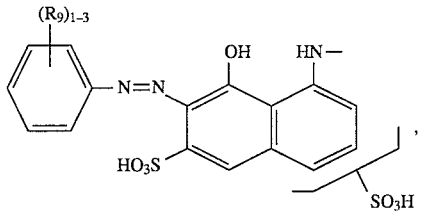

(5a)

in which $(R_9)_{1-3}$ is 1 to 3 substituents from the group consisting of $C_{1-4}$alkyl, $C_{1-4}$alkoxy, halogen, carboxyl and sulfo;

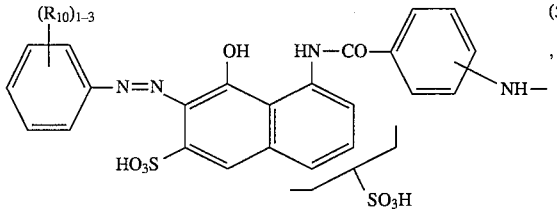

(5b)

in which $(R_{10})_{1-3}$ is 1 to 3 substituents from the group consisting of $C_{1-4}$alkyl, $C_{1-4}$alkoxy, halogen, carboxyl and sulfo;

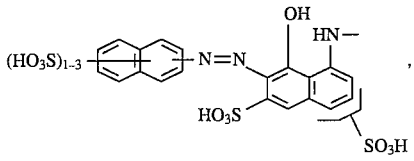

(5c)

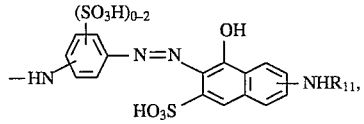

(5d)

in which $R_{11}$ is $C_{2-4}$alkanoyl or benzoyl;

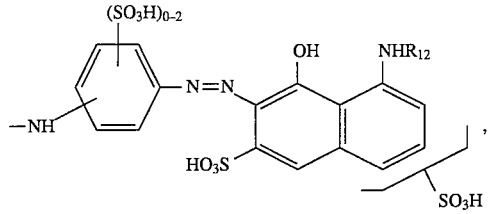

(5e)

in which $R_{12}$ is $C_{2-4}$alkanoyl or benzoyl;

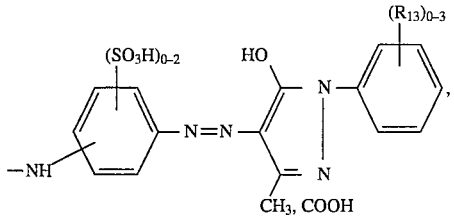

(5f)

in which $(R_{13})_{0-3}$ is 0 to 3 substituents from the group consisting of $C_{1-4}$alkyl, $C_{1-4}$alkoxy, halogen, carboxyl and sulfo;

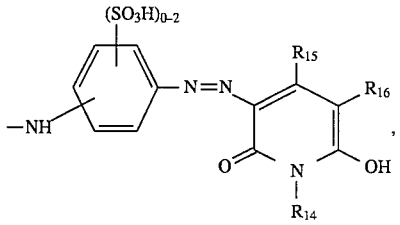

(5g)

in which $R_{14}$ and $R_{15}$, independently of one another, are hydrogen, $C_{1-4}$alkyl or phenyl and $R_{16}$ is hydrogen, cyano, carbamoyl or sulfomethyl;

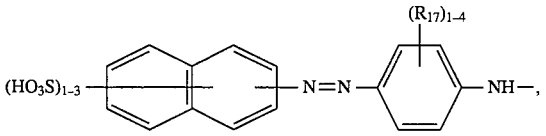

(5h)

in which $(R_{17})_{1-4}$ is 1 to 4 substituents from the group consisting of hydrogen, halogen, nitro, cyano, trifluoromethyl, sulfamoyl, carbamoyl, $C_{1-4}$alkyl, $C_{1-4}$alkoxy, amino, acetylamino, ureido, hydroxyl, carboxyl, sulfomethyl and sulfo, each $R_{17}$ being independent of the others; and

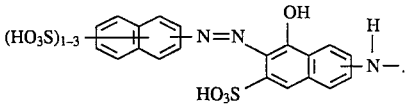

(5i)

In a further preferred embodiment of the process according to the invention, the water-insoluble or spanngly water-soluble dyes used are azo dyes of the formula

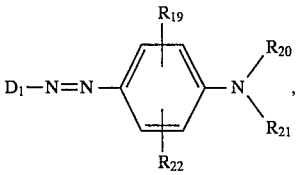

(6)

in which $D_1$ is the radical of a carbocyclic or heterocyclic diazo component free of water-solubilising substituents;

$R_{19}$ is chlorine, methyl, methoxy, methoxyethyl, methoxyethoxy or hydrogen;

$R_{20}$ and $R_{21}$, independently of one another, are $C_1$–$C_6$alkyl, $C_3$–$C_6$alkenyl, phenyl or the radical $—B_1—P_1$;

$R_{22}$ is hydrogen, methyl, methoxy, chlorine, bromine or the radical $P_1$;

$P_1$ is a radical having a polymerisable double bond;

$B_1$ is a substituted or unsubstituted radical of the formula $—(CH_2)_b—(C_6H_4)_c—(CH_2)_o—$;

in which b is an integer from 1 to 6 c is 0 or 1 and o is an integer from 0 to 6;

and at least one of the radicals $R_{20}$, $R_{21}$ or $R_{22}$ has the meaning of $P_1$ or is substituted by a radical $P_1$.

$D_1$ is preferably the radical of a homo- or heterocyclic diazo component, for example from the thienyl, phenylazothienyl, thiazolyl, isothiazolyl, 1,2,4-thiadiazolyl, 1,3,4-thiadiazolyl, benzothiazolyl, benzoisothiazolyl, pyrazolyl, 1,2,3-triazolyl, 1,2,4-triazolyl, imidazolyl or phenyl series. Each of these systems can carry further substituents, such as alkyl, alkoxy or alkylthio each having 1 to 4 carbon atoms, phenyl, electronegative groups, such as halogen, in particular chlorine or bromine, trifluoromethyl, cyano, nitro, acyl, for example acetyl or benzoyl, carboalkoxy, in particular carbomethoxy or carboethoxy, alkylsulfonyl of 1 to 4 carbon atoms, phenylsulfonyl, phenoxysulfonyl, sulfonamido or arylazo, in particular phenylazo. Any 2 adjacent substituents of the ring systems mentioned together can also form further fused-on rings, for example phenyl rings or cyclic imides.

$D_1$ is particularly preferably a benzothiazolyl, benzoisothiazolyl or phenyl radical which is unsubstituted or mono- or disubstituted by one of the abovementioned radicals.

The alkyl radicals can be substituted, for example by hydroxyl, alkoxy of 1 to 4 carbon atoms, in particular methoxy, cyano or phenyl. Further suitable substituents are halogen, such as fluorine, chlorine or bromine, or —CO—U or —O—CO—U, in which U is alkyl of 1 to 6 carbon atoms or phenyl.

Suitable alkenyl radicals are those derived from the alkyl radicals listed above by replacing at least one single bond by a double bond. Examples of suitable radicals are ethenyl or propenyl.

Phenyl radicals are understood to mean substituted or unsubstituted phenyl radicals. Examples of suitable substituents are $C_1$–$C_4$alkyl, $C_1$–$C_4$alkoxy, bromine, chlorine, nitro or $C_1$–$C_4$alkylcarbonylamino.

Examples of suitable radicals P are radicals derived from acrylic, methacrylic or cinnamic acid. Radicals of the formula $—CO—CH=CH_2$, $—CO—C(CH_3)=CH_2$, $—CO—CBr=CH_2$, $—CO—CCl=CH_2$, $—CO—CH=CH—C_6H_5$, $—O—CO—CO=CH_2$, $—O—CO—C(CH_3)=CH_2$, $—O—CO—CBr=CH_2$, $—O—CO—CH=CH—C_6H_5$, $—CH=CH_2$, $—CH=CH—C_6H_5$, $—C(CH_3)=CH_2$, $—SO_2—CH=CH_2$, $—O—CO—CCl=CH_2$ or $—C_6H_4—SO_2—CH=CH_2$ may be mentioned in particular.

Particular preference is given to dyes of the formula

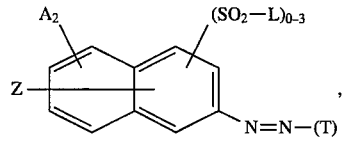

(11)

in which

L is OH or

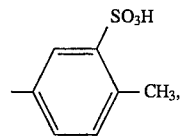

(12)

$A_2$ is hydrogen or $C_1$–$C_3$alkyl,

T is a radial of the formula
(13)
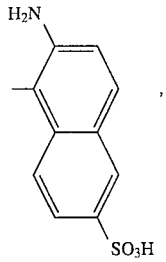
(14)
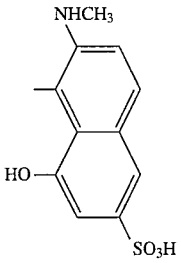
(15)
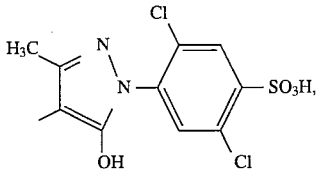
(16)
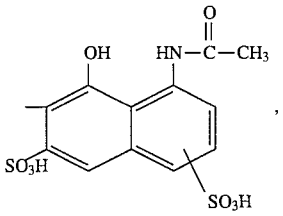
(17)
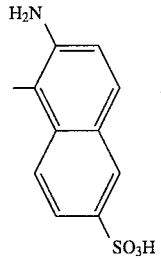
(18)
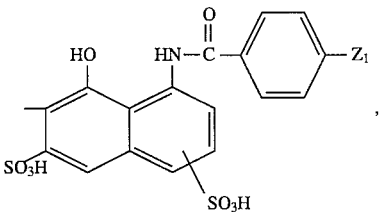
(19)
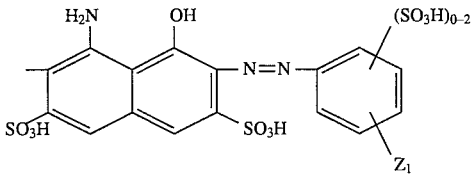
-continued
(20)
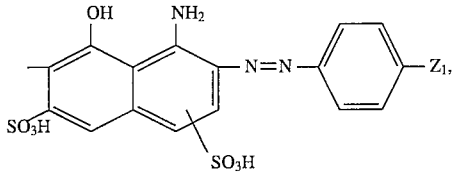
(21)
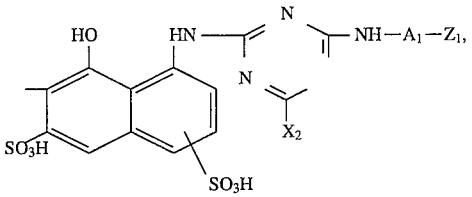
and
(22)
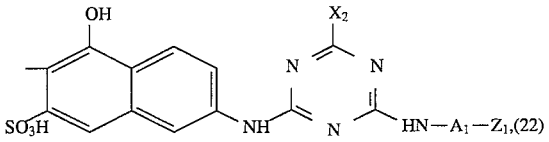
Z and $Z_1$, independently of one another, are hydrogen or the radicals of the formulae
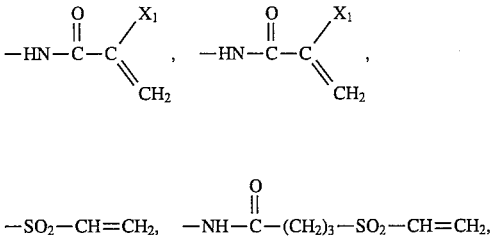
$X_2$ is chlorine or fluorine,
$X_1$ and $X_{1'}$, independently of one another, are hydrogen, chlorine, bromine or methyl and
$A_1$ is a direct bond,
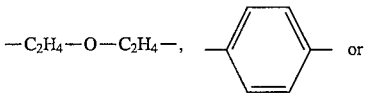
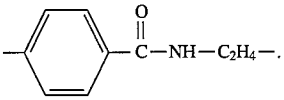
Examples of the above dyes are dyes of the formulae:

(23)
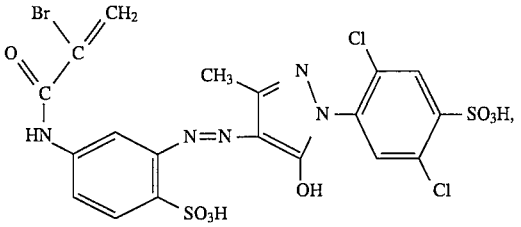
(24)
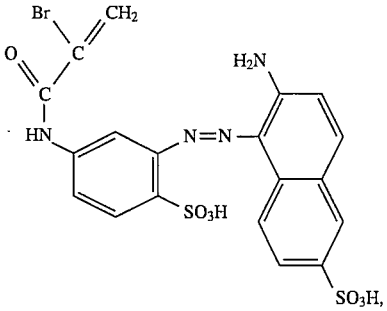
(25)
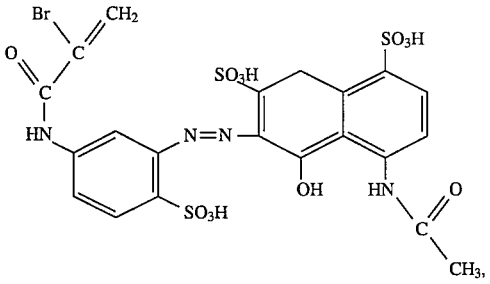
(26)
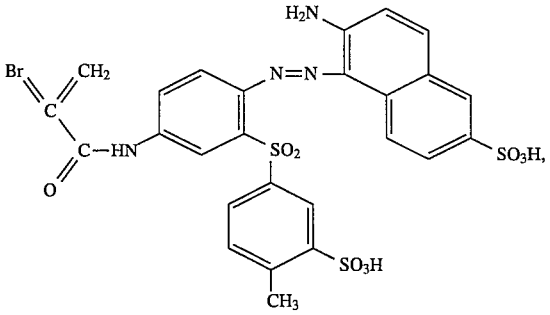
(27)
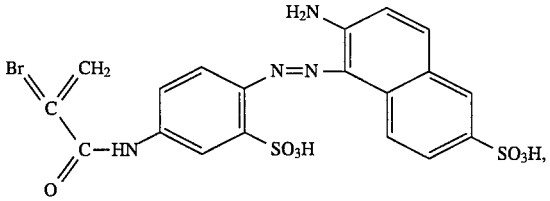
(28)
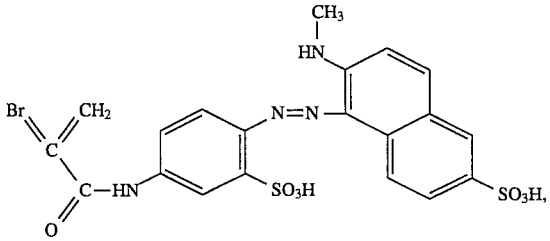

-continued
(29)
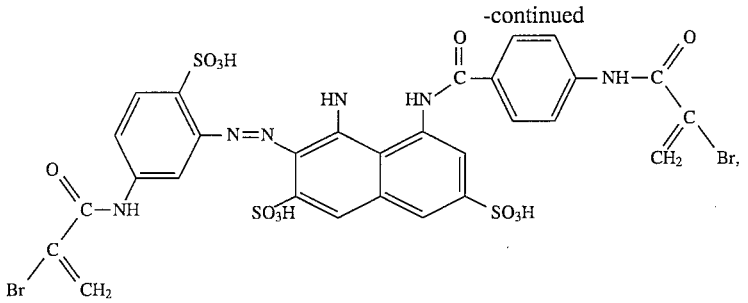
(30)
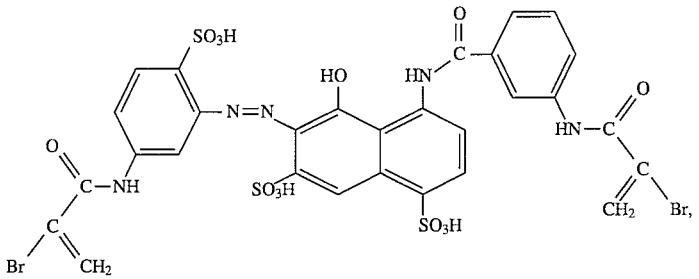
(31)
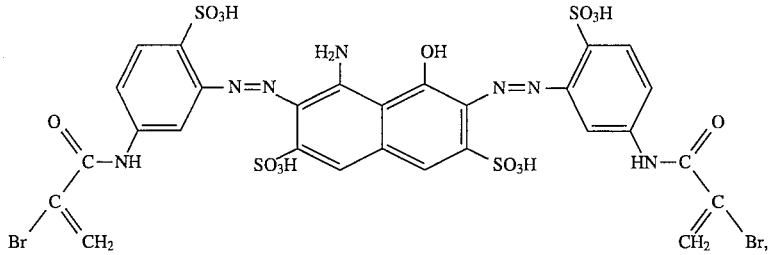
(32)
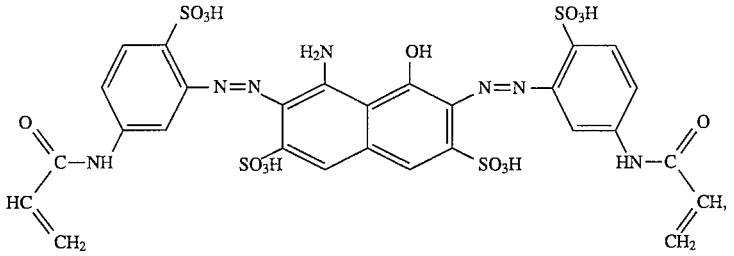
(33)
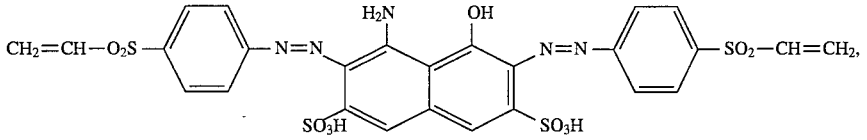
(34)
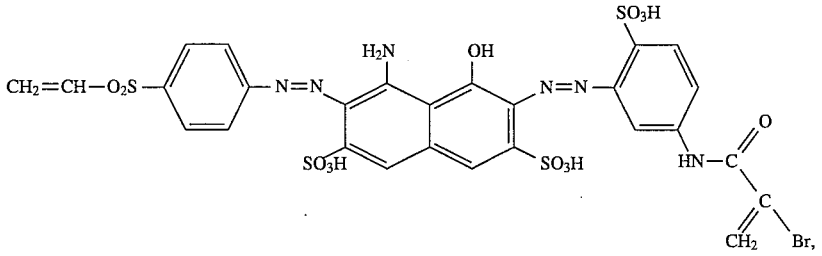

-continued
(35)
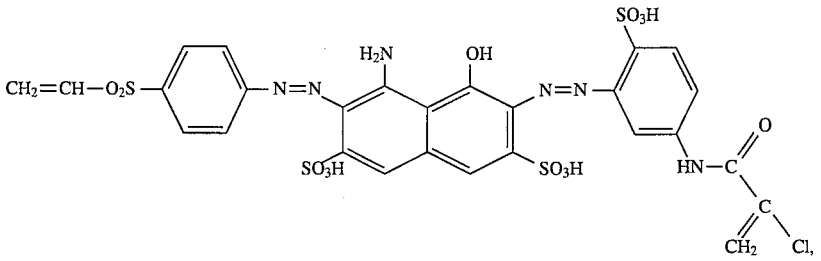
(36)
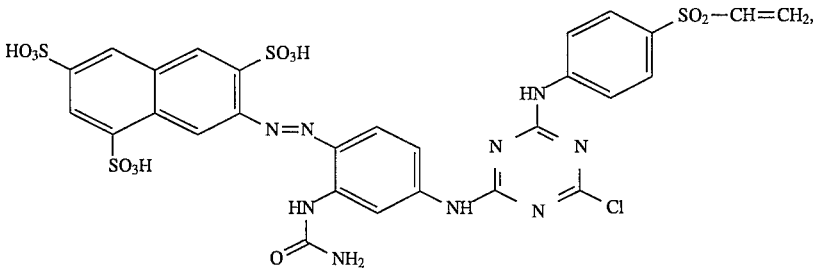
(37)
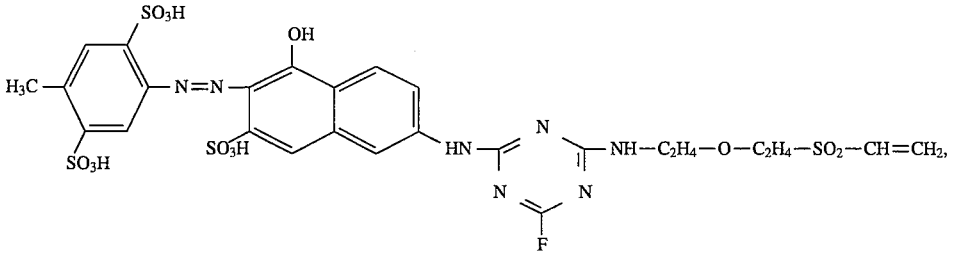
(38)
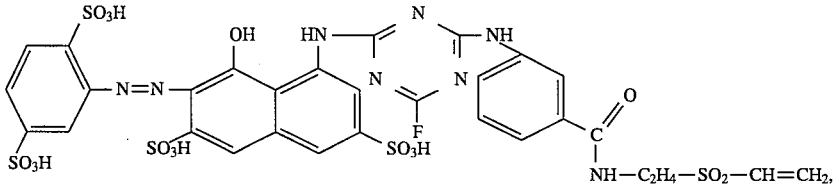
(39)
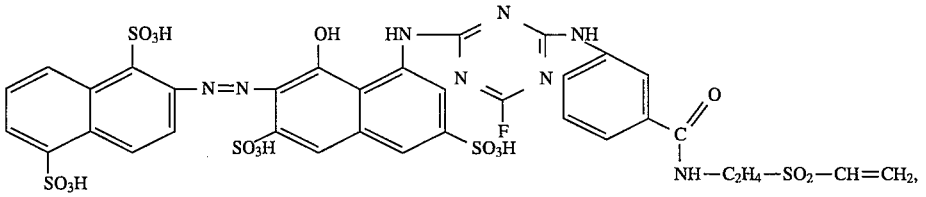
(40)
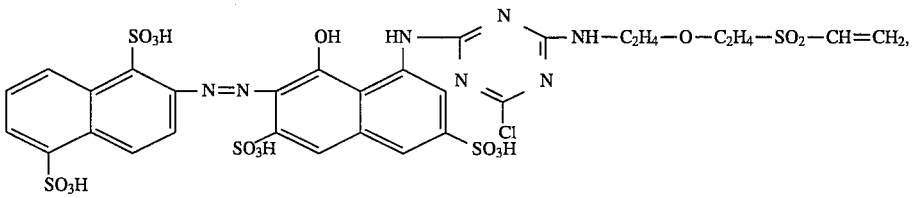
(41)
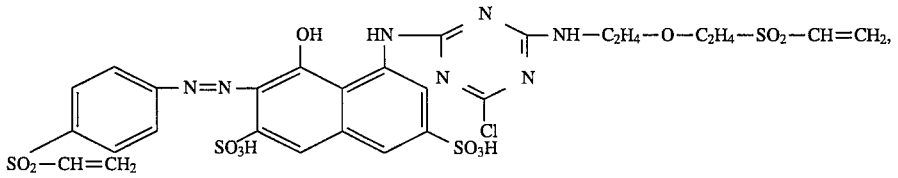

-continued
(42)
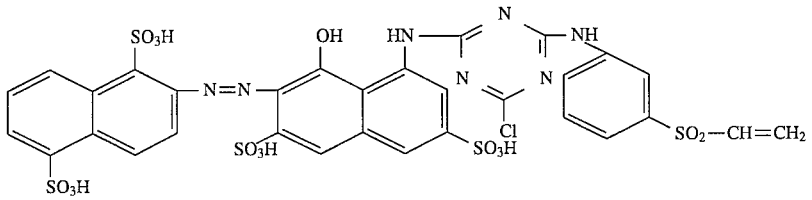
and
(43)
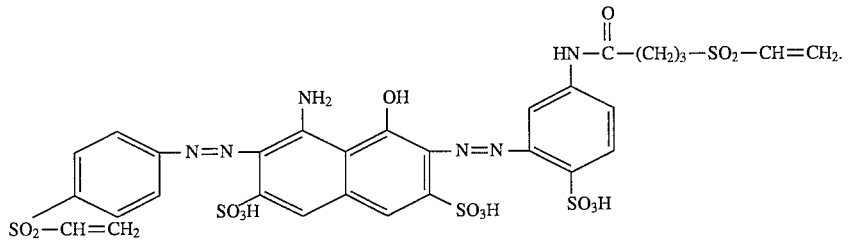
Further preferred dyes are formazan dyes of the formula
(44)
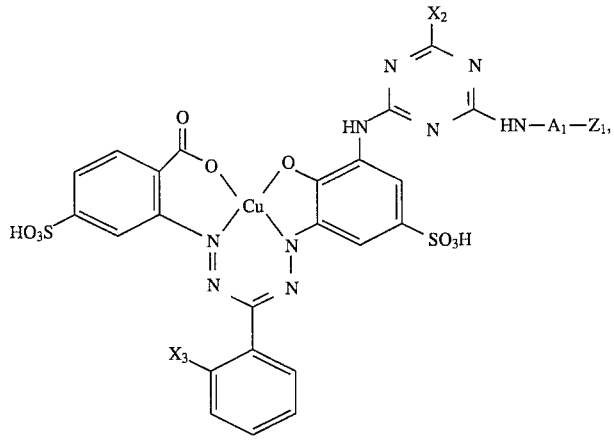
in which
$Z_1$, is a radical of the formulae
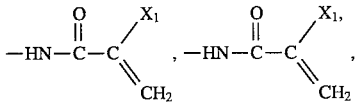
$-SO_2-CH=CH_2$, $-NH-C(=O)(CH_2)_3-SO_2-CH=CH_2$;
$X_1$ and $X_1$, are independently of one another hydrogen, chlorine, bromine or methyl,
$X_2$ is chlorine or fluorine,
$X_3$ is hydrogen or $SO_3H$ and
$A_1$ is a direct bond,
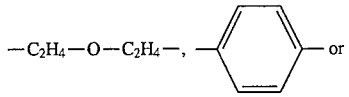
-continued
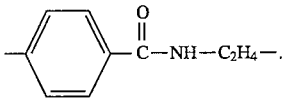
Examples of the above dyes are dyes of the formulae:

(44a)
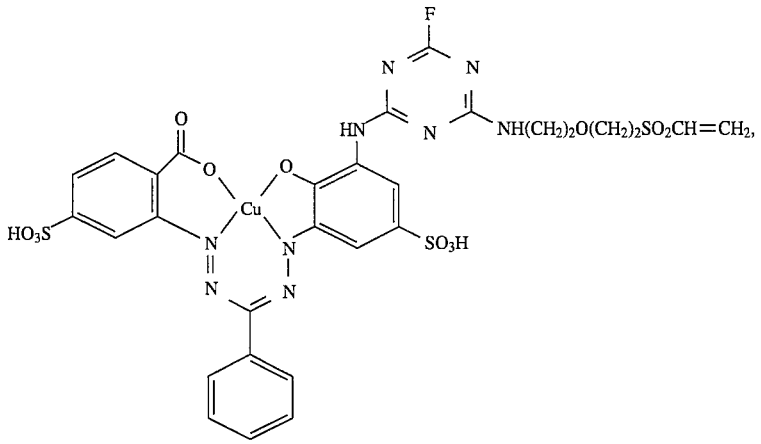
(44b)
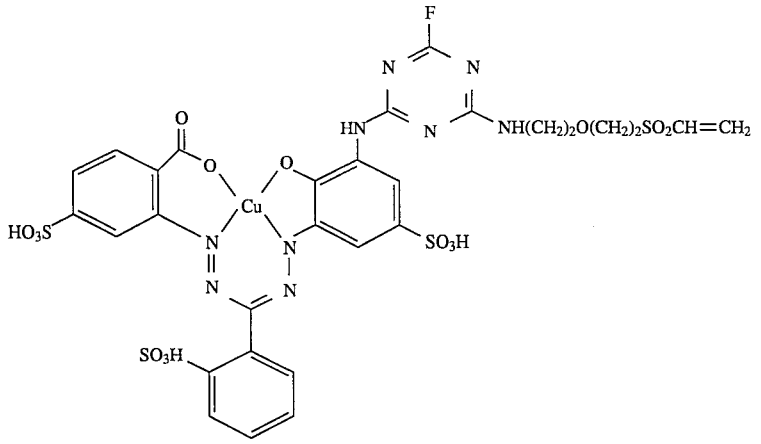
and
(44c)
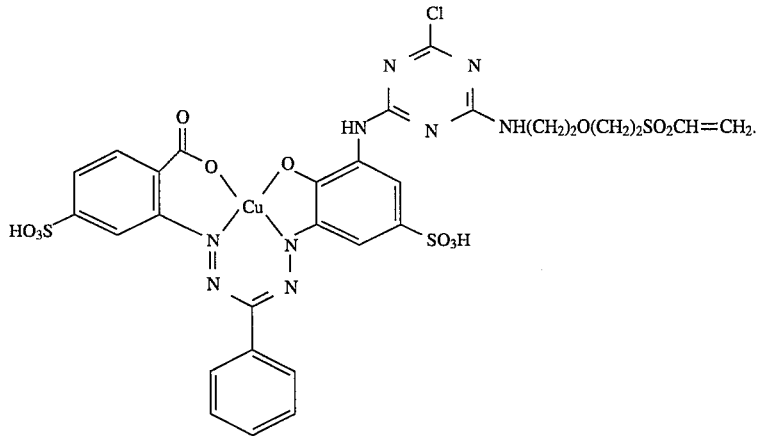
Further preferred dyes are sparingly water-soluble or water-insoluble dyes from the anthraquinone series, for example
(2a)
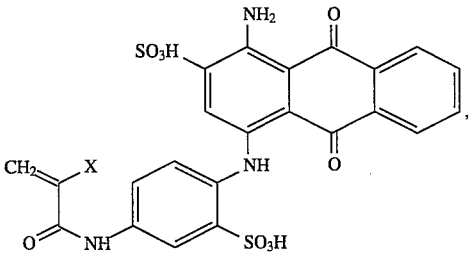

in which X is hydrogen, chlorine, bromine or methyl.

The dyes mentioned are known or can be prepared by known methods.

The cationic compounds to be used are colourless or almost colourless quarternary ammonium salts also carrying at least one polymerisable double bond or are mixtures thereof. Preference is given to those of the general formula $$(R_1R_2R_{2'}R_{2''}N)_m^+(A)^{m-}, \quad (7)$$

in which $R_1$ is a radical of the formula $$CH_2{=}CX{-}Y{-}Q{-} \quad (7a)$$

in which

X is hydrogen, $C_{1-2}$alkyl or halogen,

Y is —CO—O—, —CO—NH— or a direct bond,

Q is $-CH_2-CHOH-CH_2-$, $-(CH_2)_t-$ or $-(CH_2-CH_2-O)_t-CH_2-CH_2-$,

A is an anion from the group consisting of halides, sulfates, alkyl$_{1-2}$sulfates, thiosulfates, phosphates, carboxylates and sulfonates, $R_2$, $R_{2'}$ and $R_{2''}$, independently of one another are hydrogen, $C_{1-24}$alkyl or $R_1$, or the quaternary nitrogen atom in formula (7) can also be a member of an N heterocyclic ring which may be substituted or unsubstituted and may contain further hetero atoms, m is 1, 2 or 3 and t is an integer between 1 and 20.

Quaternary ammonium salts of the formulae $$CH_2{=}CH{-}CO{-}O{-}CH_2{-}CH_2{-}N(CH_3)_3^+A^- \quad (7b),$$

$$CH_2{=}C(CH_3){-}CO{-}O{-}CH_2{-}CH_2{-}N(CH_3)_3^+A^- \quad (7c),$$

$$CH_2{=}C(CH_3){-}CO{-}NH{-}CH_2{-}CH_2{-}CH_2{-}N(CH_3)_3^+A^- \quad (7d)$$

and $$CH_2{=}C(CH_3){-}CO{-}O{-}CH_2{-}CHOH{-}CH_2{-}N(CH_3)_3^+A^- \quad (7e)$$

in which A is as defined above are particularly preferably used.

A further example of such quaternary compounds is a compound of the formula $$(CH_3)_2(CH_2{=}CH{-}CH_2)_2N^+A^- \quad (7f).$$

The nonionic compounds to be used are polymerisable colourless or almost colourless, for example possibly slightly yellowish, monomeric, oligomeric or polymeric compounds or mixtures thereof: for example N—$C_{1-4}$alkylolacrylamide, N-butoxymethylacrylamide, N-isobutoxymethylacrylamide, N—$C_{1-4}$alkylolmethacrylamide, N-butyoxymethylmethyacrylamide, N-isobutoxymethylmethacrylamide, N,N-di($C_{1-4}$alkylol)acrylamide, N,N-di(butoxymethyl)acrylamide, N,N-di(isobutoxymethyl)acrylamide, N,N-di($C_{1-4}$methylol)methacrylamide, N,N-di(butoxymethyl)methacrylamide, N,N-di(isobutoxymethyl)methacrylamide.

Colourless compounds preferably used in the process according to the invention are monomeric, oligomeric or polymeric organic compounds or mixtures thereof.

Nonionic colourless compounds particularly preferably used in the process according to the invention are acrylates, diacrylates, triacrylates, polyacrylates, acrylic acid, methacrylates, dimethacrylates, trimethacrylates, polymethacrylates, methacrylic acid, acrylamide and acrylamides, diacrylamides, methacrylamide and methacrylamides and dimethacrylamides.

Mixtures of monomeric and oligomeric colourless organic compounds are very particularly preferably used in the process according to the invention.

Very particularly preferably, diacrylates of the general formula $$CH_2{=}CR_3{-}CO{-}O{-}(CH_2{-}CH_2{-}O)_n{-}CO{-}CR_3{=}CH_2 \quad (9)$$

are used in which $R_3$ is hydrogen or $C_{1-2}$alkyl and n is an integer between 1 and 12.

Acrylates of the formula $$CH_2{=}CR_3{-}Y{-}Q{-}R_{18} \quad (10)$$

in which Y, Q and $R_3$ are as defined above and, $R_{18}$ is 2-oxazolidon-3-yl are also particularly preferably used.

The colourtess nonionic compounds containing at least one polymerisable double bond are free of colouring radicals. They are monomeric, oligomeric or polymeric organic compounds or a mixture thereof which can be polymerised or crosslinked.

A suitable monomeric colourless compound is one having a molecular weight of up to about 1000 and containing at least one polymerisable group.

Bi-, tri- and polyfunctional monomers are also suitable.

The monomeric colourless compound can be used directly by itself or as a mixture with other monomers, oligomers and/or polymers.

A suitable oligomefic colourless compound is one having a molecular weight of between 1000 and 10,000 and containing one or more polymerisable groups. The oligomeric colourless compound can, if liquid, be used directly by itself or as a solution in water or organic solyents or as a mixture with other toohomers, oligomers and/or polymers.

A suitable polymeric colourless compound is one having a molecular weight of >10,000 and containing one or more polymerisable groups.

The polymeric colourless compound can, if liquid, be used directly by itself or as a solution in water or organic solyents or as a mixture with other monomers, oligomers, and/or polymers.

Suitable colourless compounds are ethylenically unsaturated monomeric, oligomeric and polymeric compounds.

Examples of particularly suitable compounds are esters of ethylenically unsaturated carboxylic acids and polyols or polyepoxides, and polymers having ethylenically unsaturated groups in the chain or in side groups, for example unsaturated polyesters, polyamides and polyurethanes and copolymers thereof, polybutadiene and butadiene copolymers, polyisoprene and isoprene copolymers, polymers and copolymers having (meth)acrylic groups in side chains, and mixtures of one or more of such polymers.

Examples of unsaturated carboxylic acids are acrylic acid, methacrylic acid, crotonic acid, iraconic acid, cinnamic acid and unsaturated fatty acids, such as linolenic acid or oleic acid. Acrylic and methacrylic acid are preferred.

Suitable polyols are aliphatic and cvcloaliphatic polyols. Examples of polyepoxides are those based on polyols and epichlorohydrin. Furthermore, suitable polyols are also polymers or copolymers containing hydroxyl groups in the polymer chain or side groups, for example polyvinyl alcohol and copolymers thereof or poly(hydroxyalkyl) methacrylates or copolymers thereof. Further suitable polyols are hydroxyl-terminated oligoesters.

Examples of aliphatic and cycloaliphatic polyols are alkylenediols having preferably 2 to 12 C atoms, such as ethylene glycol, 1,2- or 1,3-propanediol, 1,2-, 1,3- or 1,4-butanediol, pentanediol, hexanediol, octanediol, dodecanediol, diethylene glycol, rriethylene glycol, polyethylene glycols having molecular weights of, preferably, 200 to 1500, 1,3cyclopentanediol, 1,2-, 1,3-or 1,4-cyclohexanediol, 1,4-dihydroxymethylcyclohexane, glycerol, tris(13-hydroxyethyl)amine, trimethylolethane, trimethylolpropane, pentaerythritol, dipentaerythritol and sorbitol.

The polyols can be partially or completely esterified with one or various unsaturated carboxylic acids, it being possible for the free hydroxyl groups in partial esters to be modified, for example esterified, or to be esterified with other carboxylic acids.

Examples of esters are:

trimethylolpropane triacrylate, trimethylolethane triacrylate, trimethylolpropane trimethacrylate, trimethylolethane trimethacrylate, tetramethylene glycol dimethacrylate, triethylene glycol dimethacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentaacrylate, dipentaerythritol hexaacrylate, tripentaerythritol octaacrylate, pentaerythritol dimethacrylate, pentaerythritol trimethacrylate, dipentaerythritol dimethacrylate, dipentaerythritol tetramethacrylate, tripentaerythritol octamethacrylate, pentaerythritol diitaconate, dipentaerythritol triitaconate, dipentaerythritol pentaitaconate, dipentaerythritol hexaitaconate, ethylene glycol dimethacrylate, 1,3-butanediol diacrylate, 1,3-butanediol dimethacrylate, 1,4-butanediol diitaconate, sorbitol triacrylate, sorbitol tetraacrylate, modified pentaerythritol triacrylate, sorbitol tetramethacrylate, sorbitol pentaacrylate, sorbitol hexaacrylate, oligoester acrylates and oligoester methacrylates, glycerol di- and triacrylate, 1,4-cyclohexanediol diacrylate, bisacrylates and bismethacrylates of polyethylene glycol of molecular weight 200–1500, or mixtures thereof.

Suitable colourless compounds are also the amides of the same or different unsaturated carboxylic acids with aromatic, cycloaliphatic and aliphatic polyamines having preferably 2 to 6, in particular 2 to 4, amino groups. Examples of such polyamines are ethylenediamine, 1,2-or 1,3-propylenediamine, 1,2-, 1,3-or 1,4-butylenediamine, 1,5-pentylenediamine, 1,6-hexylenediamine, octylenediamine, dodecylenediamine, 1,4-diaminocyclohexane, isophoronediamine, phenylenediamine, bisphenylenediamine, di-β-aminoethyl ether, diethylenetriamine, triethylenetetramine, di-(13-aminoethoxy)- or di-(β-aminopropoxy) ethane. Further suitable polyamines are polymers and copolymers containing amino groups in the side chain and amino-terminated oligoamides.

Examples of such unsaturated amides are: methylenebisacrylamide, 1,6-hexamethylenebisacrylamide, diethylenetriaminetrismethacrylamide, bis(methacrylamidopropoxy) ethane, β-methacrylamidoethyl methacrylate, N-[(β-hydroxyethoxy)ethyl]acrylamide.

Suitable unsaturated polyesters and polyamides are derived, for example, from maleic acid and diols or aliamines. Maleic acid can be replaced in pan by other dicarboxylic acids. They can be used together with ethylenically unsaturated comonomers, for example styrene. The polyesters and polyamides can also be derived from dicarboxylic acids and ethylenically unsaturated diols or diamines, in particular from longer-chain ones having, for example, 6 to 20 C atoms. Examples of polyurethanes are those synthesised from saturated or unsaturated diisocyanates and unsaturated or saturated diols.

Polybutadiene and polyisoprene and copolymers thereof are known. Examples of suitable comohomers are olefins, such as ethylene, propene, butene, hexene, (meth)acrylate, acrylonitrile, styrene or vinyl chloride. Polymers having (meth)acrylate groups in the side chain are also known. They can be, for example, reaction products of novolak-based epoxy resins with (meth)acrylic acid, homo- or copolymers of polyvinyl alcohol or hydroxyalkyl derivatives thereof esterified with (meth)acrylic acid, or homo- and copolymers of (meth)acrylates esterified with hydroxyalkyl (meth)acrylates.

The colourless compounds can be used by themselves or in any desired mixture. Examples of suitable oligomeric or polymeric colourless compounds are preferably various polyester acrylatcs, for example $CH_2{=}CH{-}[CO{-}O((CH_2)_n]{-}CO{-}O{-}CH{=}CH_2$, epoxy acrylatcs, for example $(CH_2{=}CH{-}CO{-}O{-}CH_2{-}CH_2{-}O{-}C_6H_4)_2C(CH_3)_2$, urethane acrylates, for example

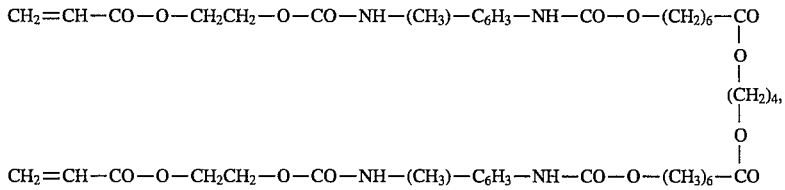

polyether acrylates, for example

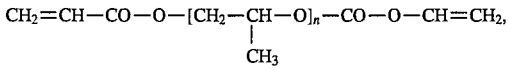

and silicone acrylates, such as disclosed in Textilpraxis International (1987), pages 848–852.

In a preferred embodiment of the process according to the invention, the colourless compounds used are those having an acrylic radical as the polymerisable group, particular preference being given to oligomeric polyether acrylates, polyurethane acrylates and polyester acrylates.

The colourless compound used in the process according to the invention is in particular N-vinylpyrrolidine, acrylic acid, butyl acrylate, 2-ethylhexyl acrylate, 2-hydroxyethyl acrylate, hydroxypropyl acrylate, butanediol monoacrylate, 2-ethoxyethyl acrylate, ethylene glycol acrylate, butanediol acrylate, 2-ethoxyethyl acrylate, ethylene glycol acrylate, bisacrylates of polyethylene glycol having a molecular weight of 200 to 1500, butanediol diacrylate, tetraethylene glycol diacrylate, 1,6-hexanediol diacrylate, diethylene glycol diacrylate, dipropylene glycol diacrylate, triethylene glycol diacrylate, tripropylene glycol diacrylate, trimethylolpropane triacryhtte, pentaerythritol triacrylate, bromoacrylamide, methylenebisdi(bromoacrylamide), methylenebis(diacrylamide), N-alkoxyacrylamide, tetraethylene glycol diacrylate, soya bean oil acrylate, polybutadiene acrylate, diethylene glycol dimethacrylate, 1,6-hexanediol dimethacrylate, 2-(2-ethoxyethoxy)ethyl acrylate, stearyl acrylate, tetrahydrofurfuryl acrylate, pentaerythritol tetraacrylate, lauryl acrylate, 2-phenoxyethyl acrylate, ethoxylated bisphenol diacrylate, di(trimethylolpropane) tetraacrylate, tris-(2-acryloyloxyethyl) isocyanurate, isodecyl acrylate, dipentaerythritol pentaacrylate, ethoxylated trimethylolpropane triacrylate, isobornyl acrylate, ethoxylated tetrabromobisphenol diacrylate, propoxylated neopentylglycol diacrylate, propoxylated glycerot triacrylate.

The cationic polymerisable compounds can be used in combination with one another or with the nonionic polymerisable compounds. Preferably, combinations of the quaternary salts of the formula $$CH_2{=}CH{-}CO{-}O{-}CH_2{-}CH_2{-}N(CH_3)_3{}^+A^- \quad (7b),$$

$$CH_2{=}C(CH_3){-}CO{-}O{-}CH_2{-}CH_2{-}N(CH_3)_3{}^+A^- \quad (7c),$$

$$CH_2{=}C(CH_3){-}CO{-}NH{-}CH_2{-}CH_2{-}CH_2{-}N(CH_3)_3{}^+A^- \quad (7d),$$

$$CH_2{=}C(CH_3){-}CO{-}O{-}CH_2{-}CHOH{-}CH_2{-}N(CH_3)_3{}^+A^- \quad (7e) \text{ or}$$

$$(CH_3)_2(CH_2{=}CH{-}CH_2)_2N^+A^- \quad (7f)$$

with a bireactive acrylic compound of the formula $$CH_2{=}CR_3{-}CO{-}O{-}(CH_2{-}CH_2{-}O)_{n'}{-}CO{-}CR_3{=}CH_2 \quad (9a)$$

are used, in which $R_3$ is hydrogen or $C_{1-2}$alkyl and n' is an integer between 1 and 9.

Also preferably, the combinations of the quaternary ammonium salts of the formula $$CH_2{=}CH{-}CO{-}O{-}CH_2{-}CH_2{-}N(CH_3)_3{}^+A^- \quad (7b),$$

$$CH_2{=}C(CH_3){-}CO{-}O{-}CH_2{-}CH_2{-}N(CH_3)_3{}^+A^- \quad (7c),$$

$$CH_2{=}C(CH_3){-}CO{-}NH{-}CH_2{-}CH_2{-}CH_2{-}N(CH_3)_3{}^+A^- \quad (7d),$$

$$CH_2{=}C(CH_3){-}CO{-}O{-}CH_2{-}CHOH{-}CH_2{-}N(CH_3)_3{}^+A^- \quad (7e) \text{ or}$$

$$(CH_3)_2(CH_2{=}CH{-}CH_2)_2N^+A^- \quad (7f)$$

with a reactive acrylic compound of the formula $$CH_2{=}CR_3{-}Y{-}Q{-}R_{18} \quad (10)$$

in which Y, Q and $R_3$ are as defined above and $R_{18}$ is 2-oxazolidon-3-yl and a bireactive acrylic compound of the formula (9a) are used.

When ultraviolet radiation is used, a photoinitiator must be present. The photoinitiator absorbs the radiation in order to produce free radicals which initiate polymerisation.

Examples of photoinitiators or photosensitisers used according to the invention are carbonyl compounds, such as 2,3-hexanedione, diacetylacetophenone, benzoin and benzoin ethers, such as dimethyl derivatives, ethyl derivatives and butyl derivatives, for example 2,2-diethoxyacetophenone and 2,2-dimethoxyacetophenone, benzophenone or a benzophenone salt and phenyl 1-hydroxycyciohexyl ketone or a ketone of the formula

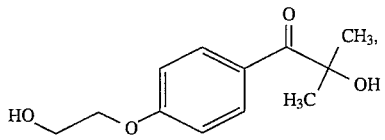

(8)

benzophenone in combination with a catalyst such as triethylamine, N,N'-dibenzylamine and dimethylaminoethanol and benzophenone plus Michler's ketone; nitrogen-containing compounds, such as diazomethane, azobisisobutyronitrile, hydrazine, phenylhydrazine and trimethylbenzylammonium chloride; and sulfur-containing compounds, such as benzenesulfonate, diphenyl disulfide and tetramethylthiuram disulfide. Photosensitisers of this type are used by themselves or in a combination with one another.

The amount of photoinitiators in the dyeing components applied directly before irradiation is 0.01–20%, preferably 0.1 to 5%, relative to the total amount of the colourless polymerisable compounds used.

Not only water-soluble but also water-insoluble photosensitisers are suitable. Moreover, copolymerisable photoinitiators such as are mentioned, for example, in "Polymers Paint Colour Journal, 180, p. 42f (1990)" are particularly advantageous.

Cationic photoinitiators, such as triarylsulfonium salts, diaryliodonium salts, diaryliron complexes or, in general, structures such as described in "Chemistry and Technology of UV & EB Formulation for Coatings, Inks & Paints" Volume 3, edited by SITA Technology Ltd., Gardiner House, Broomhill Road, London, 1991 are also suitable.

Acylphosphine oxides, for example 2,4,6-trimethylbenzoyldiphenyiphosphine oxide or photoinitiators of the formula

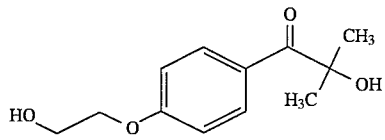

(8)

or

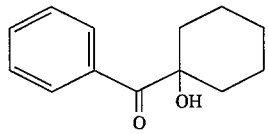

(8a)

are preferably used, or a photoinitiator of the formula

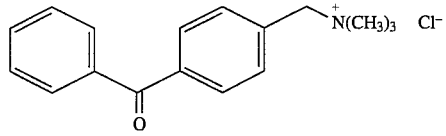

(8b)

is used together with a co-initiator of the formula (8), (8a ) or

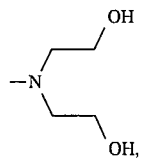

(8c)

or benzophenone is used together with a co-initiator of the formula (8), (8b ) or (8c ).

Particularly preferably, a photoinitiator of the formula

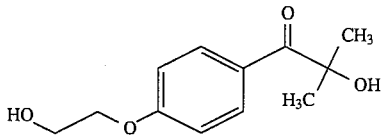

(8)

is used.

The printing pastes or dye liquors can also contain, in addition to the dye and the polymerisable compounds according to the invention, customary additives, such as thickeners, dyeing assistants, fillers, dispersants, lubricants, antioxidants and polymerisation inhibitors. Radiation-polymerisable binders usually also contain the latter as stabilisers.

Moreover, in addition to the photoinitiator, polymerisation co-initiators, such as peroxides or aliphatic azo compounds, which are activated by the heat formed upon irradiation and initiate polymerisation can be also be added.

The customary free-radical forming catalysts can be used for polymerisation or copolymerisation. These include hydrazine derivatives, such as hydrazine hydrochloride, organometallic compounds, such as tetraethyllead, and in particular aliphatic azo compounds, such as α,α'-azobisisobutyronitrile, and organic peroxides, chloroacetyl peroxide, trichloroacetyl peroxide, benzoyl peroxide, chlorobenzoyl peroxide, benzoyl acetyl peroxide, propionyl peroxide, fluorochloropropionyl peroxide, lauryl peroxide, cumene hydroperoxide, cyclohexanone hydroperoxide, tert-butyl hydroperoxide, di-tert-butyl peroxide, di-tert-amyl peroxide and p-menthane hydroperoxide, and also inorganic peroxide compounds, such as sodium peroxide, alkali metal percarbonates, alkali metal persulfates or alkali metal perborates, and in particular hydrogen peroxide, which may advantageously replace the expensive benzoyl peroxide. The amount of catalysts to be added depends in a known manner on the desired course of the reaction or on the desired properties of the polymer. Advantageously, about 0.05 to 10% by weight, relative to the total amount of binder or binder mixture, are added.

The UV light to be used is radiation whose emission is between 200 and 450 nm, in particular between 210 and 350 nm. The radiation is preferably produced artificially by means of high-, medium- or low-pressure mercury vapour lamps, halogen lamps, metal halide lamps, xenon lamps or tungsten lamps, carbon arc lamps or fluorescent lamps, H and D lamps, superactinic fluorescent tubes and lasers.

Advantageously, capillary high-pressure mercury lamps or high-pressure mercury lamps or low-pressure mercury lamps are used. High-pressure mercury lamps and medium-pressure mercury lamps, which may also be doped with iron halide or gallium halide, are very particularly advantageous. These lamps can also be excited by means of microwaves or operated in pulsed form in order to concentrate the radiation in peaks. With xenon lamps, pulsed operation is also possible for the case where a higher proportion of UV light of longer wavelength is required. In general, customary UV radiation sources such as described in "Chemistry & Technology of UV & EB Formulation for Coatings, Inks and Paints", Volume 1, pages 204 to 216, edited by SITA Technology, Gardiner House, Broomhill Road, London, 1991, are suitable.

The exact time of irradiation of the dyes or prints will depend on the luminosity of the UV source, the distance from the light source, the type and amount of photosensitiser and the UV light transmission of the formulation and the textile substrate.

Customary times of irradation are 2 seconds to 20 minutes, preferably 5 seconds to 2 minutes. Fixation can be stopped by interrupting the irradiation with light, so that it can also be carried out intermittently.

Irradiation can also be carried out under inert gas in order to prevent inhibition by oxygen, but this precaution is usually not necessary. Inhibition by oxygen can also be effectively suppressed by addition of so-called anti-blocking agents, which are amines and specifically in particular also amino acrylates.

The process according to the invention can be applied to a wide range of fibres, for example fibres of animal origin, such as wools, silks, hair (for example in the form of felt), or regenerated fibres, such as regenerated protein fibres or alginate fibres, synthetic fibres, such as polyvinyl, polyacrylonitrile, polyester, polyamide, araTnid, polypropylene or polyurethane fibres and in particular cellulose-containing materials, such as bast fibres, for example linen, hemp, jute, ramie and, in particular, cotton, and regenerated cellulose fibres, such as viscose fibres or modal fibres, cuprammonium, nitrocellulose or hydrolysed acetate fibres or fibres made of cellulose acetate, such as acetate fibre, or fibres made of cellulose triacetate, such as Arnel, Trilan®, Coupleta® or Tficel®.

The fibres mentioned can be present in forms such as are used in particular in the textile industry, for example as filaments or yarns or as woven fabrics, knitted fabrics or non-wovens, such as felts.

Fibre materials preferably used in the process according to the invention are wool, silk, hair, alginate fibres, polyvinyl, polyacrylonitrile, polyester, polyamide, aramid, polypropylene or polyurethane fibres or cellulose-containing fibres.

Particularly preferably, cellulose fibres and polyester/cellulose blend fabrics are used.

Treatment of the material to be dyed with a dye according to the definition can take place in the usual manner, for example, in the case of a textile fabric, by impregnation with a dye solution in an exhaust bath or by spraying onto the fabric or by padding with a padding solution, or by printing, for example, in a screen printing machine or by means of the ink-jet printing method.

The dyed fibre material can be irradiated in the wet, moist or dry state.

In general, the colourless compounds, the photoinitiator and the remaining additives are applied to the material to be dyed together with the dye. However, it is also possible to apply the colourless compounds and/or the photosensitiser and, if desired, the polymerisation co-initiators separately, for example, in the form of a pre- or aftertreatment. In the case where a water-insoluble photoinitiator is used and the dyeing is produced by the exhaust method or by padding, it is advantageous first to impregnate the woven fabric or knitted fabric with the photoinitiator and then to dye it with the dye liquor also containing a photosensitiser.

Emulsion printing processes in which the mixture of the radiation-polymerisable compounds replaces the hydrophobic component, so that neither varnish makers and painters naphtha nor thickeners are required, are also advantageous.

The process is suitable in particular for carrying out continuous dyeing and fixation processes but the process or individual steps thereof can also be carried out batchwise.

Furthermore the invention relates to preparations comprising a dye containing at least one polymerisable double bond or at least one polymerisable ring system, at least one colourless cationic compound containing at least one polymerisable double bond, and, if desired, a colourless nonionic compound containing at least one polymerisable double bond, and at least one photoinitiator. Preferred preparations contain those preferred individual components whose details have been given in the description of the dyes, colourless binders and photoinitiators. These preparations can contain further additives customary for dyeing or printing. Thus, such a preparation can also be, for example, a ready-to-use ink for an ink jet printer.

Preference is given to preparations comprising (a) 5–30 parts by weight of a dye, (b) 5–70 parts by weight of a colourless cationic compound, (c) 0–60 parts by weight of a nonionic colourless compound and (d) 0.01–5 parts by weight of a photoinitiator, relative to 100 parts by weight of the preparation.

Particular preference is given to preparations comprising

10–20 parts by weight of component (a),

10–60 parts by weight of component (b),

0–60 parts by weight of component (c) and 0.02–5 parts by weight of component (d), relative to 100 parts by weight of the preparation.

Very particular preference is given to preparations comprising 5 to 30 parts by weight of a dye of the formula (11) given or of a dye of the formula (44) given or of a dye of the formula (2a) given as component (a), 5 to 70 parts by weight of a quaternnry ammonium salt of the formula (7b–7f), in which $A^-$ is chloride or methylsulfate, as component (b), 0 to 60 parts by weight of an oligoethylene glyco diacrylate as component (c) and (0.01 to 5 parts by weight of a photoinitiator of the formula (8), relative to 100 parts by weight of the preparation.

Very particular preference is also given to preparations comprising 10 to 20 parts by weight of a dye of the formula (11) given or of a dye of the formula (44) given or of a dye of the formula (2a) given as component (a), 10 to 60 parts by weight of a quaternary ammonium salt of the formula (7b–7f), in which $A^-$ is chloride or methylsulfate, as component (b), 0 to 60 parts by weight of an oligoethylene glycol diacrylate as component (c) and 0.02 to 5 parts by weight of a photoinitiator of the formula (8), relative to 100 parts by weight of the preparation.

In order to prepare a dye liquor or printing paste, the concentrated preparations described can be diluted to any desired, required dye concentration, it being possible for the nonionic colourless component (c), in the case where it is not already present in the preparations, either to be added to the liquor in concentrations of 75–125 g/l or to have already previously been applied to the fibre material in concentrations of 50–90 g/kg.

The examples which follow serve to illustrate the invention. Therein, parts and percentages are by weight. The temperatures are given in degrees centigrade. Parts by weight relate to parts by volume as the gram relates to the cubic centimeter.

In the use examples which follow, irradiation is carried out using a 120 watt mercury high-pressure lamp or a fusion D lamp at transporting rates of 10 m/min. The energy of radiation applied is 295 mJ/cm$^2$ per side of fabric.

The oligoethylene glycol diacrylate used hits an average molecular weight of 508 g/mol.

The degrees of fixation were determined by stripping the dye from an irradiated unwashed and from a non-irradiated stamped specimen of size (2.5 cm )$^2$. The specimens were treated once at room temperature with 25 ml of a solution of 600 ml/l of phosphate buffer (pH 7) and 40 ml/l of tetramethylurea in deionised water for 20 minutes and then once at 100° C. with 25 ml of this solution for 20 minutes. Both extracts of each specimen were combined and measured by spectroscopy. The degrees of fixation were determined from the absorbances ($\lambda_{max}$) of the extracts of the corresponding stamped specimens.

EXAMPLE 1

A cotton satin fabric is padded with an aqueous solution comprising 30 g/l of a dye of the formula

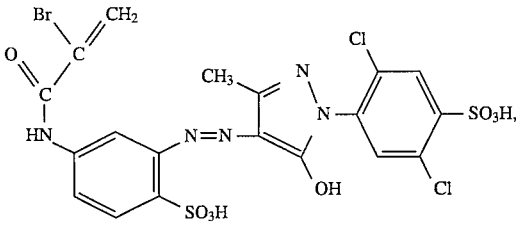

(23)

100 g/l of an oligoethylene glycol diacrylate, 100 g/l of $CH_2{=}C(CH_3){-}CO{-}CH_2{-}CHOH{-}CH_2{-}N(CH_3{}^+Cl^-$, 100 g/l of urea and 10 g/l of the photoinitiator of the formula

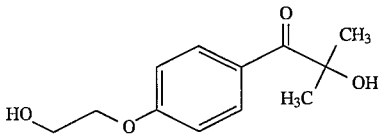

(8)

(liquor pickup about 70%). The fabric is dried and then irradiated on both sides with UV light. This is done by moving the specimen forward on a conveyor belt moving at a rate of 10 m/min under a mercury high-pressure lamp having an output of 120 watt/cm. A brilliant yellow dyeing having a degree of fixation of 84% is obtained.

The following dyes are applied by repeating this example, giving the degrees of fixation shown:

| Dye | Degree of fixation |
|---|---|
| 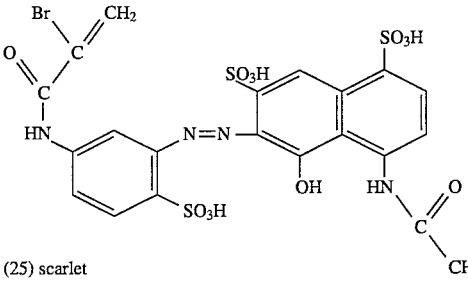 (25) scarlet | 78% |

-continued

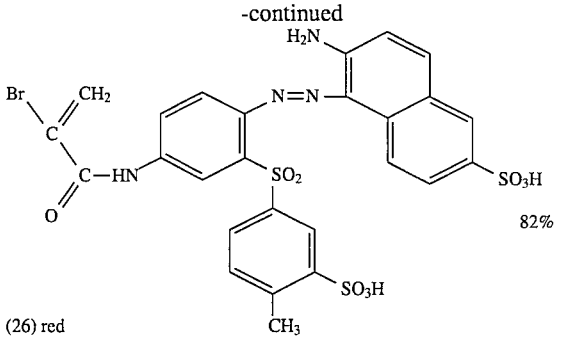

82%

(26) red

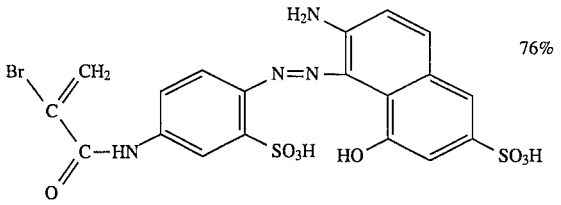

76%

(27) red

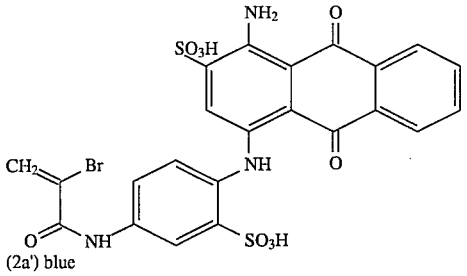

(2a') blue

EXAMPLE 2

A cotton satin fabric is padded with an aqueous solution comprising 30 g/l of a dye of the formula

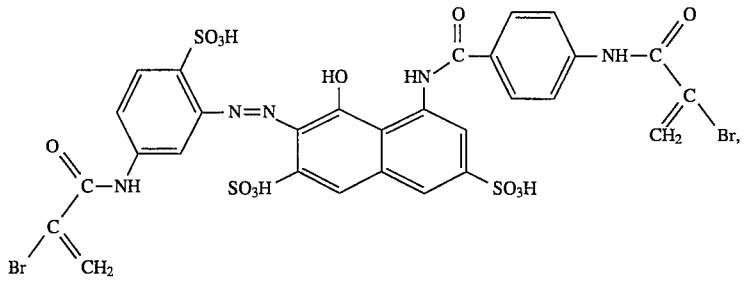

(29)

100 g/l of an oligoethylene glycol diacrylate, 100 g/l of $CH_2{=}C(CH_3){-}CO{-}O{-}CH_2{-}CHOH{-}CH_2{-}N(CH_3)_3^+Cl^-$ and 10 g/l of the photoinitiator of the formula

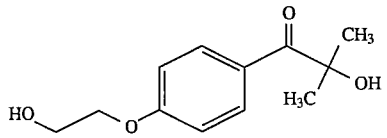

(8)

(liquor pickup about 70%). The fabric is dried and then irradiated on both sides with UV light. This is done by moving the specimen forward on a conveyor belt moving at a rate of 10 m/min under two mercury high-pressure lamps having an output of 80 watt/cm each. A brilliant red dyeing having a degree of fixation of 96% is obtained.

EXAMPLE 3

A cotton satin fabric is dyed, dried and then irradiated on both sides with UV light as in Example 1. This is done by moving the specimen forward on a conveyor belt moving at a rate of 10 m/min under a mercury high-pressure lamp having an output of 80 watt/cm. A brilliant red dyeing having a degree of fixation of 93% is obtained.

EXAMPLE 4

A cotton satin fabric is dyed, dried and then irradiated on both sides with UV light as in Example 1. This is done by moving the specimen forward on a conveyor belt moving at a rate of 20 m/min under two mercury high-pressure lamps having an output of 120 watt/cm each. A brilliant red dveing having a degree of fixation of 96% is obtained.

EXAMPLE 5

A cotton satin fabric is dyed, dried and then irradiated on both sides with UV light as in Example 1. This is done by moving the specimen forward on a conveyor belt moving at a rate of 10 m/min under a fusion D lamp having an output of 120 watt/cm. A brilliant red dyelag having a degree of fixation of 93% is obtained.

EXAMPLE 6

A cotton satin fabric is dyed, dried and irradiated as described in Example 1, except that only 5 g/l of photoinitiator are used instead of 10 g/l, giving a brilliant red dyeing having a degree of fixation of 96%.

EXAMPLE 7

A cotton satin fabric is dyed, dried and irradiated as described in Example 2, except that only 5 g/l of photoinitiator are used instead of 10 g/l, giving a brilliant red dyeing having a degree of fixation of 93%.

EXAMPLE 8

A cotton satin fabric is dyed, dried and irradiated as described in Example 3, except that only 5 g/l of photoinitiator are used instead of 10 g/l, giving a brilliant red dyeing having a degree of fixation of 96%.

EXAMPLE 9

A cotton satin fabric is padded with an aqueous solution comprising 30 g/l of a dye of the formula

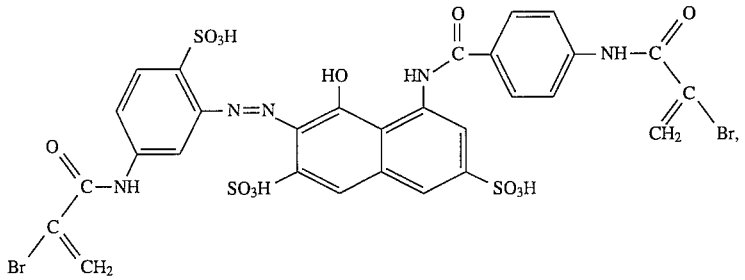

(29)

100 g/l of an oligoethylene glycol diacrylate, 100 g/l of $CH_2{=}C(CH_3)—CO—O—CH_2—CHOH—CH_2—N(CH_3)_3^+Cl^-$, 100 g/l of urea and 10 g/l of the photoinitiator of the formula

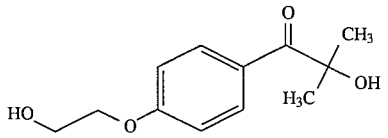

(8)

(liquor pickup about 70%). The fabric is dried and then irradiated on both sides with UV light. This is done by moving the specimen forward on a conveyor belt moving at a rate of 10 m/min under a mercury high-pressure lamp having an output of 120 watt/cm. A brilliant red dyeing having a degree of fixation of 96% is obtained.

EXAMPLE 10

A cotton satin fabric is padded with an aqueous solution comprising 30 g/l of a dye of the formula

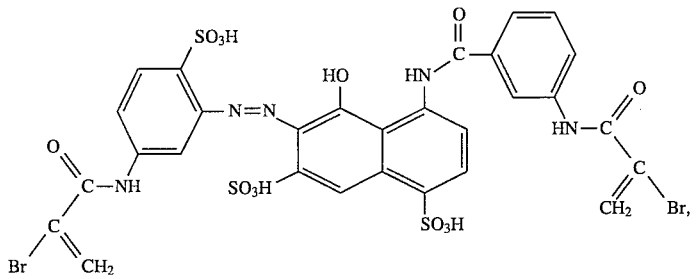

(30)

100 g/l of an oligoethylene glycol diacrylate, 100 g/l of $CH_2{=}C(CH_3)—CO—O—CH_2—CHOH—CH_2—N(CH_3)_3^+Cl^-$, 100 g/l of urea and 10 g/l of the photoinitiator of the formula

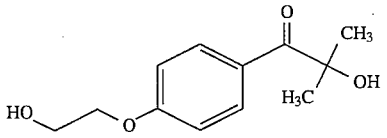

(8)

(liquor pickup about 70%). The fabric is dried and then irradiated on both sides with UV light. This is done by moving the specimen forward on a conveyor belt moving at a rate of 10 n/min under a mercury high-pressure lamp having an output of 120 watt/cm. A brilliant red dyeing having a degree of fixation of 93% is obtained.

EXAMPLE 11

A cotton satin fabric is padded with an aqueous solution comprising 20 g/l of a dye of the formula

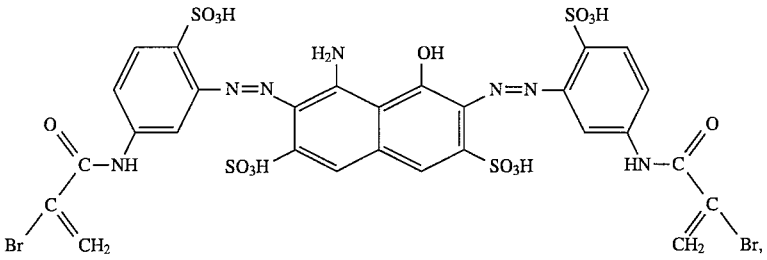

(31)

100 g/l of an oligoethylene glycol diacrylate, 100 g/l of $CH_2{=}C(CH_3){-}CO{-}O{-}CH_2{-}CHOH{-}CH_2{-}N(CH_3)_3^+Cl^-$, 100 g/l of urea and 10 g/l of the photoinitiator of the formula

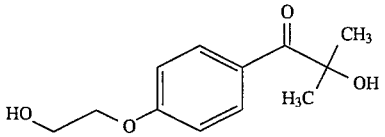

(8)

(liquor pickup about 70%). The fabric is dried and then irradiated on both sides with UV light. This is done by moving the specimen forward on a conveyor belt moving at a rate of 10 m/min under a mercury high-pressure lamp having an output of 120 watt/cm. A dyeing having a degree of fixation of 96% is obtained.

EXAMPLE 12

A cotton satin fabric is padded with an aqueous solution comprising 13.4 g/l of a dye of the formula

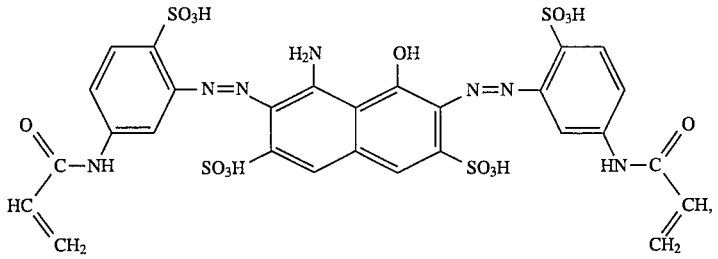

(32)

100 g/l of an oligoethylene glycol diacrylate, 100 g/l of $CH_2{=}C(CH_3){-}CO{-}O{-}CH_2{-}CHOH{-}CH_2{-}N(CH_3)_3^+Cl^-$, 100 g/l of urea and 10 g/l of the photoinitiator of the formula

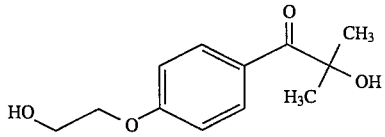

(8)

(liquor pickup about 70%). The fabric is dried and then irradiated on both sides with UV light. This is done by moving the specimen forward on a conveyor belt moving at a rate of 10 m/min under a mercury high-pressure lamp having an output of 95% is obtained.

EXAMPLE 13

A cotton satin fabric is padded with an aqueous solution comprising 24.3 g/l of a dye of the formula

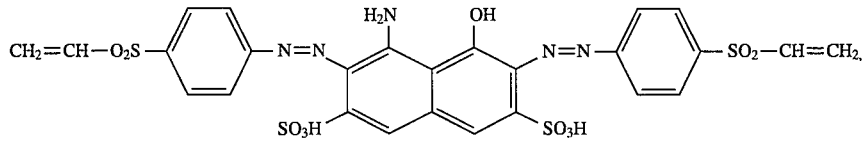

(33)

100 g/l of an oligoethylene glycol diacrylate, 100 g/l of $CH_2{=}C(CH_3){-}CO{-}O{-}CH_2{-}CHOH{-}CH_2{-}N(CH_3)_3^+Cl^-$, 100 g/l of urea and 10 g/l of the photoinitiator of the formula

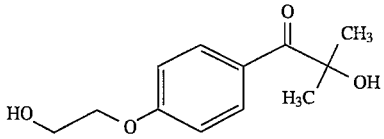

(8)

(liquor pickup about 70%). The fabric is dried and then irradiated on both sides with UV light. This is done by moving the specimen forward on a conveyor belt moving at a rate of 10 m/min under a mercury high-pressure lamp having an output of 120 watt/cm. A dyeing having a degree of fixation of 86% is obtained.

EXAMPLE 14

A cotton satin fabric is padded with a mixture comprising the dyes listed in Table 1 in the amounts given there, 100 g/l of an oligoethylene glycol diacrylate (average molecular weight 508 g/mole), 85 g/l of (methacryloyloxyethyl)trimethylammonium chloride, 100 g/l of urea and 10 g/l of 4-(2-hydmxyethoxy)phenyl (2-hydroxy-2-propyl) ketone (liquor pickup about 70%). The fabric is dried and then irradiated on both sides with UV light. This is done by moving the specimen forward on a conveyor belt moving at a rate of 10 m/min under two mercury high-pressure lamps having an output of 80 watt/cm each. Dyeings having the degrees of fixation shown in Table 1 are obtained.

TABLE 1

| Dye formula No. | Amount in g/l | Degree of fixation |
|---|---|---|
| (36) Yellow | 50.6 | 96% |
| (37) Orange | 17.2 | 96% |
| (38) Red | 34.2 | 96% |
| (39) Red | 31.6 | 97% |
| (40) Red | 23.4 | 96% |
| (44a) Blue | 24.1 | 966 |
| (43) Navy | 26.5 | 94% |
| (34) Navy | 20.4 | 96% |

EXAMPLE 15

A cotton satin fabric is printed with a paste comprising 30 g/kg of a paste of a dye of the formula

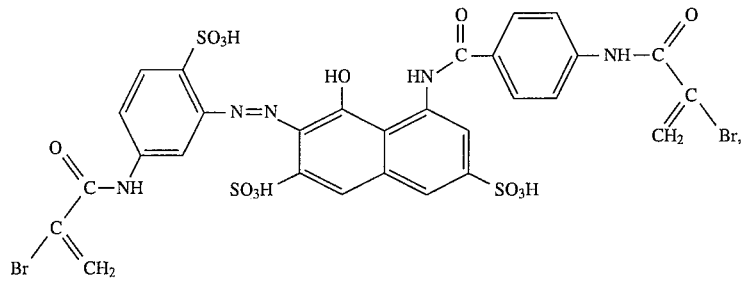

(29)

100 g/kg of a paste of an oligoethylene glycol diacrylate, 85 g/kg of a paste of the compound of the formula $$CH_2{=}CCH_3{-}CO{-}O{-}CH_2{-}N^{\oplus}(CH_3)_3Cl^{\ominus},$$

30 kg of a paste of alginate, 7.5 kg of a paste of Calgon, 7 kg of a paste of the compound of the formula

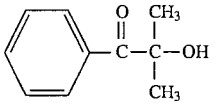

and 3 g/kg of a paste of the compound of the formula

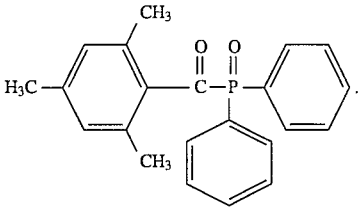

Without prior ctrying, the print is then irractiatect on both sides with UV light. This is done by clamping the wet specimen into a stenter frame and moving it forward on a conveyor belt moving at a rate of 5 m/min under an iron-doped mercury lamp of the "fusion D" type. The specimen is then turned around, and the back is irradiated under the same conditions. A red print having a degree of fixation of 95% is obtained.

What is claimed is:

1. A process for the dyeing or printing of organic material, which comprises applying a dye containing at least one polymerisable double bond together with at least one colourless cationic compound containing at least one polymerisable double bond, and at least one photoinitiator, and optionally one or more colourless nonionic compounds containing at least one polymerisable double bond, and optionally further auxiliaries to the organic material, and then fixing them by means of UV light, whose emission is between 200 and 450 nm.

2. A process according to claim 1, wherein the colourless nonionic compound is a monomeric, oligomeric or polymeric organic compound containing at least one polymerisable double bond or a mixture thereof.

3. A process according to claim 1, wherein the cationic colourless compound is a quaternary ammonium salt carrying at least one polymerisable double bond, or a mixture thereof.

4. A process according to claim 3, wherein the colourless cationic compound is a quaternary ammonium salt of the formula $$(R_1R_2R_{2'}R_{2''}N)_m^{+}(A)^{m-}, \quad (7)$$

in which $R_1$ is a radical of the formula $$CH_2{=}CX{-}Y{-}Z{-} \quad (7a)$$

in which

X is hydrogen, $C_{1-2}$alkyl or halogen,

Y is —CO—O—, —CO—NH— or a direct bond,

Q is $-CH_2-CHOH-CH_2-$, $-(CH_2)_t-$ or $-(CH_2-CH_2-O)_tCH_2-CH_2-$,

A is an anion selected from the group consisting of haHdes, sulfates, $C_{1-2}$alkyl sulfates, thiosulfates, phosphates, carboxylates and sulfonates, $R_2$, $R_{2'}$, and $R_{2''}$, independently of one another, are hydrogen, $C_{1-24}$alkyl or $R_1$, or the quaternary nitrogen atom in formula (7) is a member of an N heterocyclic ring which is substituted or unsubstituted and can contain further hetero atoms, m is 1, 2 or 3 and t is an integer between 1 and 20.

5. A process according to claim 1, wherien the colourless nonionic compound is selected from the group consisting of acrylates, methacrylates, acrylamides and methacrylamides.

6. A process according to claim 4, wherein the colourless cationic compound is a quaternary ammonium salt of the formula $$CH_2{=}CH{-}CO{-}O{-}CH_2{-}CH_2{-}N(CH_3)_3^{+}A^{-} \quad (7b),$$

$$CH_2{=}C(CH_3){-}CO{-}O{-}CH_2{-}CH_2{-}N(CH_3)_3^{+}A^{-} \quad (7c),$$

$$CH_2{=}C(CH_3){-}CO{-}NH{-}CH_2{-}CH_2{-}CH_2{-}N(CH_3)_3^{+}A^{-} \quad (7d),$$

$$CH_2{=}C(CH_3){-}CO{-}O{-}CH_2{-}CHOH{-}CH_2{-}N(CH_3)_3^{+}A^{-} \quad (7e) \text{ or}$$

$$(CH_3)_2(CH_2{=}CH{-}CH_2)_2N^{+}A^{-} \quad (7f)$$

in which A is an anion selected from the group consisting of halides, sulfates, $C_{1-2}$alkyl sulfates, thiosulfates, phosphates, carboxylates and sulfonates.

7. A process according to claim 5, wherein the colourless nonionic compound is a diacrylate of the formula $$CH_2{=}CR_3{-}CO{-}O{-}(CH_2{-}CH_2{-}O)_n{-}CO{-}CR_3{=}CH_2 \quad (9)$$

in which $R_3$ is hydrogen or $C_{1-2}$alkyl and n is an integer between 1 and 12.

8. A process according to claim 1, wherein the dye applied has the formula $$D—(P)_r \quad (1)$$

in which D is the radical of an organic dye selected from the group consisting of monoazo, polyazo, metal complex azo, anthraquinone, phthalocyanine, formazan, azomethine, nitroaryl, dioxazine, phenazine, stilbene, triphenylmethane, xanthene, thioxanthone, naphthoquinone, pyrenequinone and perylenetetracarbimide series, P is a radical having a polymerisable double bond and r is the number 1, 2, 3, 4, 5 or 6.

9. A process according to claim 8, wherein the dye applied has the formula $$D'—(P)_r \quad (1a)$$

in which P is a radical having a polymerisable double bond, r is the number 1, 2, 3, 4, 5 or 6 and D' is the radical of an organic dye selected from the group consisting of monoazo, polyazo, formazan, anthraquinone, phthalocyanine and dioxazine series.

10. A process according to claim 1, wherein the dye contains at least one acrylamide, methacrylamide, bromoacrylamide, chloroacrylamide or vinylsulfonyl group.

11. A process according to claim 8, wherein the dye has at least one radical having a polymerisable double bond which is selected from the group consisting of acrylamide, methacrylamide, bromoacrylamide, chloroacrylamide and vinylsulfonyl.

12. A process according to claim 1, wherein the UV source used is one or more conventional UV light producing lamps.

13. A process according to claim 12, wherein the conventional UV light producing lamp is selected from the group consisting of high-, medium- or low-pressure mercury vapour lamps, halogen lamps, metal halide lamps, xenon lamps, tungsten lamps, carbon arc lamps, fluorescent lamps, H lamps, D lamps, superactinic fluorescent tubes and lasers.

14. A process according to claim 13, wherein an undoped or iron- or gallium-doped high-, medium- or low-pressure mercury vapour lamp is used.

15. A process according to claim 14, wherein a mercury high-pressure lamp or an iron-doped mercury medium-pressure lamp is used.

16. A process accoridng to claim 1, wherein the photoinitiator is selected from the group consisting of carbonyl compounds, acylphosphine oxides, nitrogen-containing compounds, sulfur-containing compounds, and water-soluble copolymerisable photosensitisers.

17. A process according to claim 16, wherein the photoinitiator is 2,3-hexanedione, diacetylacetophenone, benzoin, 2,2-diethoxyacetophenone, 2,2-dimethoxyacetophenone, benzophenone, phenyl 1-hydroxycyclohexyl ketone, a ketone of the formula

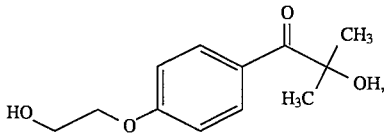

(8)

diazomethane, azobisisobutyronitrile, hydrazine, phenylhydrazine, trimethylbenzylammonium chloride, a compound of the formula

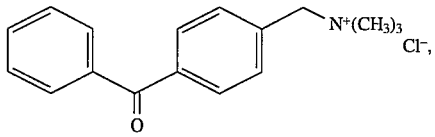

(8b)

methyldiethanol amine, 2,4,6-trimethylbenzoyldiphenylphosphine oxide, benzenesulfonate, diphenyl disulfide or tetramethylthiuram disulfide.

18. A process according to claim 1, wherein printing takes place by means of an ink-jet printer.

19. A process according to claim 1, wherein the fixation is carried out under an inert gas atmosphere.

20. A process according to claim 1, wherein the organic material is a fibre material.

21. A process according to claim 20, wherein the fibre material used is wool, silk, hair, alginate fibres, polyvinyl, polyacrylonitrile, polyester, synthetic polyamide, polypropylene or polyurethane fibres, cellulose-containing fibres or glass fibres.

22. A process according to claim 21, wherein dyed or printed cellulose fibres or cellulose-containing fibres and polyester fibres are used.

23. A process according to claim 22, wherein polyester/cellulose blend fabrics are used.

24. A process according to claim 20, wherein the dyes or printed fibre material is fixed while wet.

25. A process according to claim 20, wherein the dyed or printed fibre material is fixed while dry.

26. A process according to claim 20, wherein the fixation takes place on both sides of the dyed or printed fibre material.

27. A fibre material dyed or printed by the process according to claim 20.

28. A preparation comprising 5 to 30 parts by weight of a dye of the formula

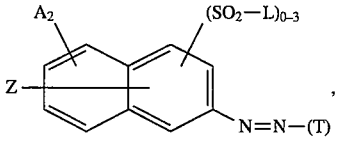

(11)

in which

L is OH or

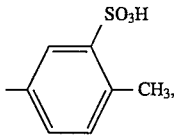

(12)

$A_2$ is hydrogen or $C_1$–$C_3$alkyl,

T is a radical of the formula

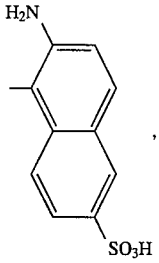

(13)

-continued
(14)
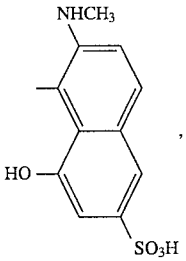
(15)
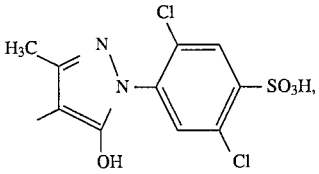
(16)
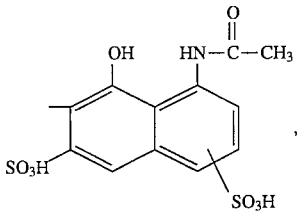
(17)
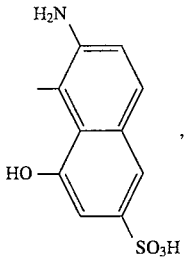
(18)
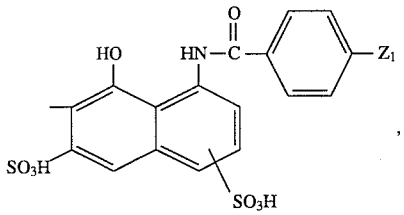
(19)
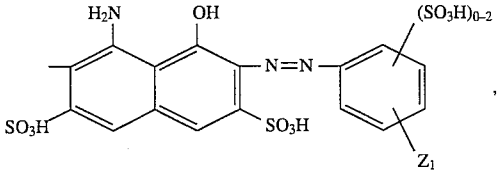
(20)
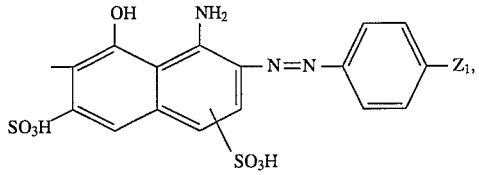
-continued
(21)
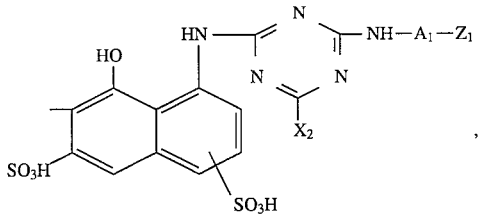
or
(22)
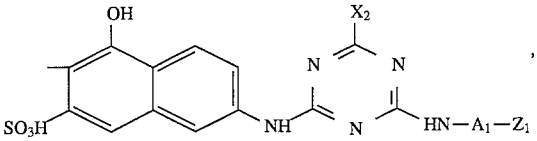
wherein
Z and $Z_1$, independently of one another, are hydrogen or a radical of the formula
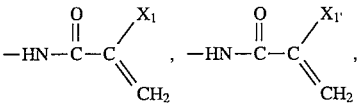
$-SO_2-CH=CH_2$ or
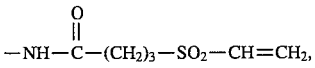
$X_2$ is chlorine or fluorine,
$X_1$ and $X_{1'}$, independently of one another, are hydrogen, chlorine, bromine or methyl, and
$A_1$ is a direct bond, $-C_2H_4-O-C_2H_4-$,
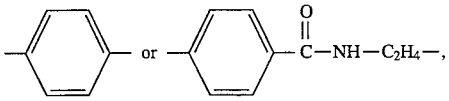
or of a dye of the formula

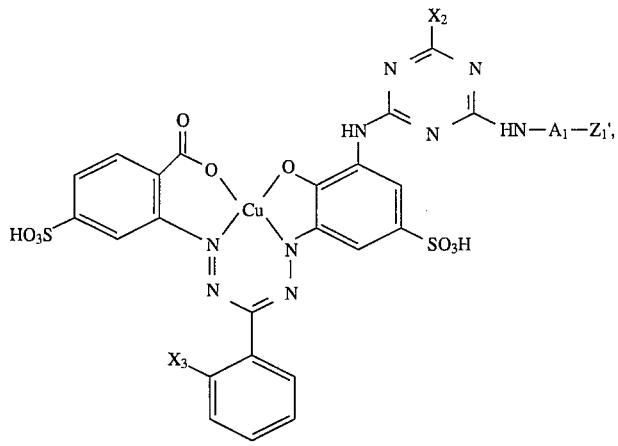

(44)

in which $Z_{1'}$ is a radical of the formula

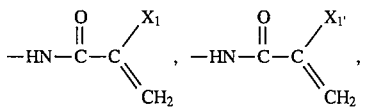

$-SO_2-CH=CH_2$ or $-NH-C(=O)-(CH_2)_3-SO_2-CH=CH_2$;

$X_1$ and $X_{1'}$ are independently of one another hydrogen, chlorine, bromine or methyl, $X_2$ is chlorine or fluorine, $X_3$ is hydrogen or $SO_3H$ and $A_1$ is a direct bond, $-C_2H_4-O-C_2H_4-$,

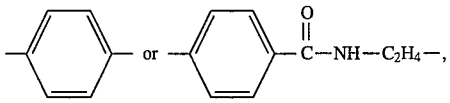

or of a dye of the formula

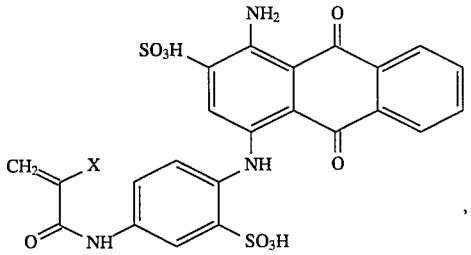

(2a)

in which X is hydrogen, chlorine, bromine or methyl, 5 to 70 parts by weight of a quarternary ammonium slat of the formula $CH_2=CH-CO-O-CH_2-CH_2-N(CH_3)_3^+A^-$ (7b), $CH_2=C(CH_3)-CO-O-CH_2-CH_2-N(CH_3)_3^+A^-$ (7c), $CH_2=C(CH_3)-CO-NH-CH_2-CH_2-CH_2-N(CH_3)_3^+A^-$ (7d), $CH_2=C(CH_3)-CO-O-CH_2-CHOH-CH_2-N(CH_3)_3^+A^-$ (7e) or $(CH_3)_2(CH_2=CH-CH_2)_2N^+A^-$ (7f)

in which $A^-$ is chloride or methylsulfate, 0 to 60 parts by weight of an oligoethylene glycol diacrylate and 0.01 to 5 parts by weight of the photoinitiator of the formula

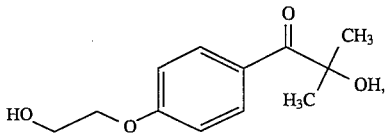

(8)

relative to 100 parts by weight of the preparation.

29. A process according to claim 5, wherein the colourless nonionic compound is an acyrlate of the formula $CH_2=CR_3-Y-Q-R_{18}$ (10)

in which

Y is —CO—O—, —CO—NH— or a direct bond,

Q is $-CH_2-CHOH-CH_2-$, $-(CH_2)_t-$ or $-(CH_2-CH_2-O)_t-CH_2-CH_2-$, $R_3$ is hydrogen or $C_{1-2}$alkyl, $R_{18}$ is 2-oxazolidon-3-yl and t is an integer between 1 and 20.

30. A process according to claim 1, wherein a mixture of at least two quaternary ammonium salts of the formula $(R_1R_2R_{2'}R_{2''}N)_m^+(A)^{m-}$, (7)

in which $R_1$ is a radical of the formula $CH_2=CX-Y-Q-$ (7a)

in which

X is hydrogen, $C_{1-2}$alkyl or halogen,

Y is —CO—O—, —CO—NH— or a direct bond,

Q is $-CH_2-CHOH-CH_2-$, $-(CH_2)_t-$ or $-(CH_2-CH_2-O)_t-CH_2-CH_2-$,

A is an anion selected from the group consisting of halides, sulfates, $C_{1-2}$alkyl sulfates, thiosulfates, phosphates, carboxylates and sulfonates, $R_2$, $R_{2'}$, $R_{2''}$, independently of one another, are hydrogen, $C_{1-24}$alkyl or $R_1$, or the quaternary nitrogen atom in formula (7) is a member of an N heterocyclic ring which is substituted or unsubstituted and can contain further hetero atoms, m is 1, 2 or 3 and t is an integer between 1 and 20 is used.

31. A process according to claim 1, wherein a mixture of at least one quaternary ammonium salt of the formula $$(R_1R_2R_{2'}R_{2''}N)_m^+(A)^{m-}, \quad (7)$$

in which $R_1$ is a radical of the formual $$CH_2{=}CX{-}Y{-}Q{-} \quad (7a)$$

in which

X is hydrogen, $C_{1-2}$alkyl or halogen,

Y is —CO—O—, —CO—NH— or a direct bond,

Q is $-CH_2-CHOH-CH_2-$, $-(CH_2)_t-$ or $-(CH_2-CH_2-O)_t-CH_2-CH_2-$,

A is an anion selected from the group consisting of halides, sulfates, $C_{1-2}$alkyl sulfates, thiosulfates, phosphates, carboxylates and sulfonates, $R_2$, $R_{2'}$, $R_{2''}$, independently of one another, are hydrogen, $C_{1-2}$alkyl or $R_1$, or the quaternary nitrogen atom in formula (7) is a member of an N heterocyclic ring which is substituted or unsubstituted and can contain further hetero atoms, m is 1, 2 or 3 and t is an integer between 1 and 20, with at least one colourless nonionic compound selected from the group consisting of acrylates, methacrylates, acrylamides and methacrylamides is used.

32. A process according to claim 30, wherein a mixture of at least two quaternary ammonium salts of the formula $$CH_2{=}CH{-}CO{-}O{-}CH_2{-}CH_2{-}N(CH_3)_3^+A^- \quad (7b),$$

$$CH_2{=}C(CH_3){-}CO{-}O{-}CH_2{-}CH_2{-}N(CH_3)_3^+A^- \quad (7c),$$

$$CH_2{=}C(CH_3){-}CO{-}NH{-}CH_2{-}CH_2{-}CH_2{-}N(CH_3)_3^+A^- \quad (7d),$$

$$CH_2{=}C(CH_3){-}CO{-}O{-}CH_2{-}CHOH{-}CH_2{-}N(CH_3)_3^+A^- \quad (7e) \text{ or}$$

$$(CH_3)_2(CH_2{=}CH{-}CH_2)_2N^+A^- \quad (7f)$$

in which A is an anion selected from the group consisting of halides, sulfates, $C_{1-2}$alkyl sulfates, thiosulfates, phosphates, carboxylates and sulfonates is used.

33. A process according to claim 31, wherein a mixture of at least one quaternary ammonium salt of the formula $$CH_2{=}CH{-}CO{-}O{-}CH_2{-}CH_2{-}N(CH_3)_3^+A^- \quad (7b),$$

$$CH_2{=}C(CH_3){-}CO{-}O{-}CH_2{-}CH_2{-}N(CH_3)_3^+A^- \quad (7c),$$

$$CH_2{=}C(CH_3){-}CO{-}NH{-}CH_2{-}CH_2{-}CH_2{-}N(CH_3)_3^+A^- \quad (7d),$$

$$CH_2{=}C(CH_3){-}CO{-}O{-}CH_2{-}CHOH{-}CH_2{-}N(CH_3)_3^+A^- \quad (7e) \text{ or}$$

$$(CH_3)_2(CH_2{=}CH{-}CH_2)_2N^+A^- \quad (7f)$$

in which A is an anion selected from the group consisting of halides, sulfates, $C_{1-2}$alkyl sulfates, thiosulfates, phosphates, carboxylates and sulfonates, with at least one diacrylate of the formula $$CH_2{=}CR_3{-}CO{-}O{-}(CH_2{-}CH_2{-}O)_n{-}CO{-}CR_3{=}CH_2 \quad (9)$$

in which $R_3$ is hydrogen or $C_{1-2}$alkyl and n is an integer between 1 and 12 is used.

34. A process according to claim 31, wherein a mixture of at least one quaternary ammonium salt of the formula $$CH_2{=}CH{-}CO{-}O{-}CH_2{-}CH_2{-}N(CH_3)_3^+A^- \quad (7b),$$

$$CH_2{=}C(CH_3){-}CO{-}O{-}CH_2{-}CH_2{-}N(CH_3)_3^+A^- \quad (7c),$$

$$CH_2{=}C(CH_3){-}CO{-}NH{-}CH_2{-}CH_2{-}CH_2{-}N(CH_3)_3^+A^- \quad (7d),$$

$$CH_2{=}C(CH_3){-}CO{-}O{-}CH_2{-}CHOH{-}CH_2{-}N(CH_3)_3^+A^- \quad (7e) \text{ or}$$

$$(CH_3)_2(CH_2{=}CH{-}CH_2)_2N^+A^- \quad (7f)$$

in which A is an anion selected from the group consisting of halides, sulfates, $C_{1-2}$alkyl sulfates, thiosulfates, phosphates, carboxylates and sulfonates, with the acrylates of the formula $$CH_2{=}CR_3{-}CO{-}O{-}(CH_2{-}CH_2{-}O)_n{-}CO{-}CR_3{=}CH_2 \quad (9)$$

and of the formula $$CH_2{=}CR_3{-}Y{-}Q{-}R_{18} \quad (10)$$

in which $R_3$ is hydrogen or $C_{1-2}$alkyl, n is an integer between 1 and 12, Y is —CO—O—, —CO—NH— or a direct bond, Q is $-CH_2-CHOH-CH_2-$, $-(CH_2)_t-$ or $-(CH_2-CH_2-O)_t-CH_2-CH_2-$, $R_3$ is hydrogen or $C_{1-2}$alkyl and, $R_{18}$ is 2-oxazolidon-3-yl is used.

35. A process according to claim 1, wherein a dye containing at least one bromoacrylamide, chloracrylamide, acrylamide or vinylsulfonyl group is used together with a quaternary ammonium salt selected from the group consisting of:

$$CH_2{=}CH{-}CO{-}O{-}CH_2{-}CH_2{-}N(CH_3)_3^+A^- \quad (7b),$$

$$CH_2{=}C(CH_3){-}CO{-}O{-}CH_2{-}CH_2{-}N(CH_3)_3^+A^- \quad (7c),$$

$$CH_2{=}C(CH_3){-}CO{-}NH{-}CH_2{-}CH_2{-}CH_2{-}N(CH_3)_3^+A^- \quad (7d),$$

$$CH_2{=}C(CH_3){-}CO{-}O{-}CH_2{-}CHOH{-}CH_2{-}N(CH_3)_3^+A^- \quad (7e) \text{ and}$$

$$(CH_3)_2(CH_2{=}CH{-}CH_2)_2N^+A^- \quad (7f)$$

in which A is halide, sulfate or $C_{1-2}$alkyl sulfate, and an acrylic compound of the formula $$CH_2{=}CR_3{-}CO{-}O{-}(CH_2{-}CH_2{-}O)_{n'}{-}CO{-}CR_3{=}CH_2 \quad (9a)$$

in which $R_3$ is hydrogen or $C_{1-2}$alkyl and n' is 1 to 9.

36. A process according to claim 1, wherein a dye containing at least one bromoacrylamide, chloroacrylamide, acrylamide or vinylsulfonyl group is used together with at least one quaternary ammonium salt selected from the group consisting of:

$$CH_2{=}CH{-}CO{-}O{-}CH_2{-}CH_2{-}N(CH_3)_3^+A^- \quad (7b),$$

$$CH_2{=}C(CH_3){-}CO{-}O{-}CH_2{-}CH_2{-}N(CH_3)_3^+A^- \quad (7c),$$

$$CH_2{=}C(CH_3){-}CO{-}NH{-}CH_2{-}CH_2{-}CH_2{-}N(CH_3)_3^+A^- \quad (7d),$$

$$CH_2{=}C(CH_3){-}CO{-}O{-}CH_2{-}CHOH{-}CH_2{-}N(CH_3)_3^+A^- \quad (7e) \text{ and}$$

$$(CH_3)_2(CH_2{=}CH{-}CH_2)_2N^+A^- \quad (7f)$$

in which A is halide, sulfate or $C_{1-2}$alkyl sulfate, an acrylic compound of the formula $$CH_2{=}CR_3{-}Y{-}Q{-}R_{18} \quad (10)$$

in which Y is —CO—O—, —CO—NH— or a direct bond,

Q is $-CH_2-CHOH-CH_2-$, $-(CH_2)_t-$ or $-(CH_2-CH_2-O)t-CH_2-CH_2-$, $R_3$ is hydrogen or $C_{1-2}$alkyl, $R_{18}$ is 2-oxazolidon-3-yl and t is an integer between 1 and 20, and an acrylic compound of the formula $$CH_2{=}CR_3{-}CO{-}O{-}(CH_2{-}CH_2{-}O)_{n'}{-}CO{-}CR_3{=}CH_2 \quad (9a)$$

in which $R_3$ is hydrogen or $C_{1-2}$alkyl and n' is 1 to 9.

37. A process according to claim 1, wherein not only dyeing or printing but also fixation of the dyes on the organic material are carried out continously.

38. A process according to claim 17, wherein a photoinitiator of the formula (8) is used.

39. A process according to claim 17, wherein the photoinitiator is 2,4,6-trimethylbenzoyldiphenylphosphine oxide, a ketone of the formula (8), or phenyl 1-hydroxycyclohexyl ketone of the formula

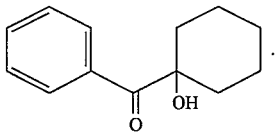

(8a)

40. A process according to claim 17, wherein the photoinitiator of the formula

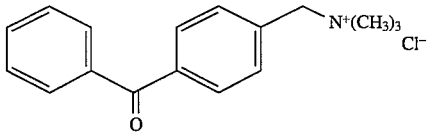

(8b)

is used together with a co-initiator of the formula (8), (8a) or

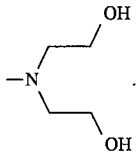

(8c)

41. A process according to claim 17, wherein benzophenone is used together with a co-initiator of the formula (8), (8b) or (8c).

* * * * *